US009649840B2

(12) United States Patent
Abe

(10) Patent No.: US 9,649,840 B2
(45) Date of Patent: May 16, 2017

(54) HEAD DRIVER FOR LIQUID DISCHARGE APPARATUS

(71) Applicant: Seiko Epson Corporation, Tokyo (JP)

(72) Inventor: Akira Abe, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/811,179

(22) Filed: Jul. 28, 2015

(65) Prior Publication Data

US 2015/0328885 A1 Nov. 19, 2015

Related U.S. Application Data

(63) Continuation of application No. 14/475,890, filed on Sep. 3, 2014, now Pat. No. 9,120,307.

(30) Foreign Application Priority Data

Sep. 5, 2013 (JP) ..... 2013-184216

(51) Int. Cl.
*B41J 29/38* (2006.01)
*B41J 2/045* (2006.01)

(52) U.S. Cl.
CPC ..... *B41J 2/04541* (2013.01); *B41J 2/04548* (2013.01); *B41J 2/04581* (2013.01); *B41J 2/04593* (2013.01); *B41J 2202/20* (2013.01)

(58) Field of Classification Search
None
See application file for complete search history.

(56) References Cited

U.S. PATENT DOCUMENTS

| | | | |
|---|---|---|---|
| 8,382,224 | B2 | 2/2013 | Tabata et al. |
| 8,632,148 | B2 | 1/2014 | Tabata et al. |
| 2007/0079710 | A1 | 4/2007 | Ishizaki |
| 2007/0165074 | A1 | 7/2007 | Ishizaki |
| 2009/0108884 | A1 | 4/2009 | Dagli et al. |
| 2009/0273625 | A1 | 11/2009 | Oshima et al. |
| 2010/0127777 | A1 | 5/2010 | Yoshino et al. |

(Continued)

FOREIGN PATENT DOCUMENTS

| | | | |
|---|---|---|---|
| JP | 2007-096364 | A | 4/2007 |
| JP | 2011-005733 | A | 1/2011 |
| JP | 2011-259548 | A | 12/2011 |

*Primary Examiner* — Matthew Luu
*Assistant Examiner* — Tracey McMillion
(74) *Attorney, Agent, or Firm* — Harness, Dickey & Pierce, P.L.C.

(57) ABSTRACT

A liquid discharge apparatus includes a power supply potential output section that outputs a first power supply potential, a first and a second switch drive section that generate a first and a second switch drive signal according to a modulation signal of an original drive signal, a first and a second switch that operate according to the first and the second switch drive signal, a rectifying device that is arranged between an output terminal of the power supply potential output section and a terminal of the first switch drive section, a connection node that is electrically connected to the first switch and the second switch, a capacitance element that is arranged between the terminal and the connection node, a signal conversion section that converts a signal which is generated at the connection node, into a drive signal, and a piezoelectric element that is transformed by the drive signal.

12 Claims, 16 Drawing Sheets

(56) References Cited

U.S. PATENT DOCUMENTS

| | | | | |
|---|---|---|---|---|
| 2010/0321111 | A1 | 12/2010 | Berkhout | |
| 2010/0328379 | A1* | 12/2010 | Tabata | B41J 2/0452 347/10 |
| 2011/0002486 | A1 | 1/2011 | Ishizaki | |
| 2011/0043559 | A1 | 2/2011 | Miyazaki et al. | |
| 2014/0098150 | A1 | 4/2014 | Tabata et al. | |

* cited by examiner

HEAD DRIVER FOR LIQUID DISCHARGE APPARATUS

CROSS-REFERENCE TO RELATED APPLICATIONS

This is a continuation application of U.S. application Ser. No. 14/475,890, filed Sep. 3, 2014, which claims priority to Japanese Patent Application No. 2013-184216, filed Sep. 5, 2013, both of which are expressly incorporated by reference herein in their entireties.

BACKGROUND

1. Technical Field

The present invention relates to a liquid discharge apparatus (liquid ejecting apparatus) that applies a drive signal to an actuator and discharges (ejects) a liquid, and for example, is suitable for a liquid ejecting type printing apparatus that is made so as to print a predetermined character, an image or the like, by ejecting a minute liquid from a nozzle of a liquid ejecting head and forming a fine particle (dot) on a printing medium.

2. Related Art

In a liquid ejecting type printing apparatus, in order to eject a liquid from a nozzle of a liquid ejecting head, an actuator such as a piezoelectric element is arranged, and it is necessary to apply a predetermined drive signal to the actuator. Since the drive signal has relatively a high potential, it is necessary to power-amplify an original signal which is a reference of the drive signal, with a power amplification circuit. Therefore, in JP-A-2011-5733, in comparison with an analog power amplifier, using a digital power amplification circuit of which a power loss is very small and a size can be miniaturized, the original signal is made as a modulation signal by pulse-modulating with a modulation circuit, the modulation signal is made as a power amplification modulation signal by power-amplifying with the digital power amplification circuit, and the power amplification modulation signal is made as a drive signal by smoothing with a smoothing filter. In the drive signal, or the original signal to be the reference thereof, there is a portion (time) where the potential does not change, but the piezoelectric element which is used as an actuator is a capacitive load, and it is not necessary to supply a current to the actuator when the potential of the drive signal does not change. Therefore, in the liquid ejecting type printing apparatus which is described in JP-A-2011-5733, when the potential of the actuator is maintained to be constant, that is, when the potential of the original signal is maintained to be constant, an operation is stopped by turning off a high side switching element Q1 in company with a low side switching element Q2 which are installed in the digital power amplification circuit, and thereby reducing power consumption in the digital power amplification circuit and the smoothing filter.

Incidentally, in JP-A-2011-5733, the low side switching element Q2 may operate using a ground potential as a reference, but the high side switching element Q1 is necessary to operate using the potential of an output node (connection node with the low side switching element Q2) as a reference. Therefore, it is not shown in JP-A-2011-5733, a bootstrap capacitor functioning as a floating power supply, is connected between an external power supply and the output node of the digital power amplification circuit. Furthermore, since the output node becomes the high potential when the high side switching element Q1 is turned on, so that the current does not flow backward to the external power supply side from the output node, a diode for backflow prevention is arranged between the external power supply and the bootstrap capacitor.

In the digital power amplification circuit of the related art described above, when the low side switching element Q2 is turned on, the current flows to the ground through the diode from the external power supply, and the bootstrap capacitor is charged. In particular, in a state where the external power supply starts, when the low side switching element Q2 is firstly turned on, a large current flows to the ground in a moment from the external power supply. Therefore, if a portion of the large current flows to the piezoelectric element which is used as an actuator through the smoothing filter, there is a concern that the liquid is discharged from the nozzle by mistake, or the piezoelectric element is damaged. Moreover, due to the large current, an output voltage of the external power supply is largely reduced in a moment, and a large reverse direction current (reverse current) to which a reverse bias is applied, flows, before a forward direction current of the diode becomes 0. Therefore, so that the diode is not damaged due to heat generation, it is necessary to use a diode having a large current resistant amount, a fast recovery diode, or the like, and it becomes a factor of a cost increase.

SUMMARY

An advantage of some aspects of the invention is to provide a liquid discharge apparatus that can reduce a concern such as an erroneous discharge of a liquid and damage of a piezoelectric element, by a current for charging a capacitance element functioning as a floating power supply.

(1) According to an aspect of the invention, there is provided a liquid discharge apparatus including a power supply potential output section that outputs a first power supply potential which rises from a reference potential to be a constant potential, a first switch drive section that generates a first switch drive signal according to a modulation signal of an original drive signal, a second switch drive section that generates a second switch drive signal according to the modulation signal, a first switch that operates according to the first switch drive signal, a second switch that operates according to the second switch drive signal, a rectifying device that is arranged between an output terminal of the power supply potential output section and a first terminal of the first switch drive section, a connection node that is electrically connected to a second terminal of the first switch and a first terminal of the second switch, a capacitance element that is arranged between the first terminal of the first switch drive section and the connection node, a signal conversion section that converts a signal which is generated at the connection node, into a drive signal, and a piezoelectric element that is transformed by the drive signal, and can carry out an operation for discharging a liquid, in which a first power supply potential is supplied to a first terminal of the second switch drive section, the reference potential is supplied to a second terminal of the second switch drive section, a second power supply potential is supplied to a first terminal of the first switch, a second terminal of the first switch drive section is connected to the connection node, and the reference potential is supplied to a second terminal of the second switch.

According to the liquid discharge apparatus, the first power supply potential rises from the reference potential, and is the constant potential, and thereby the concern that a large current instantly flows to the piezoelectric element through the connection node with the first switch and the second switch from the output terminal of the power supply potential output section, can be reduced. Therefore, it is possible to reduce the concern such as the damage of the piezoelectric element and the erroneous discharge of the liquid.

(2) In the liquid discharge apparatus, a resistance element that is arranged between the output terminal of the power supply potential output section and the capacitance element, in series with the rectifying device, may be further included.

According to the liquid discharge apparatus, since it is possible to limit the current which flows to the piezoelectric element from the output terminal of the power supply potential output section by the resistance element, it is possible to reduce the concern such as the damage of the piezoelectric element and the erroneous discharge of the liquid more.

(3) In the liquid discharge apparatus, the first terminal of the second switch and the second terminal of the second switch may be electrically connected until the first power supply potential reaches the constant potential.

According to the liquid discharge apparatus, when the first power supply potential is the lower potential before becoming the constant potential, the second switch is turned on, and a current path which is to a reference potential node from the output terminal of the power supply potential output section through the second switch, is formed. Hereby, the amount of the current which instantly flows to the reference potential node from the output terminal of the power supply potential output section, is reduced, and an instant decrease amount of the first power supply potential becomes small. Therefore, the reverse direction current which flows to the rectifying device, becomes small, and the concern such as the damage of the rectifying device, can be reduced.

(4) In the liquid discharge apparatus, when the first power supply potential begins to rise from the reference potential, the first terminal of the second switch and the second terminal of the second switch may begin to be electrically connected.

According to the liquid discharge apparatus, the first power supply potential begins to rise, and the second switch immediately begins to be turned on. Therefore, when the first power supply potential is lower, the current path which is to the reference potential node from the output terminal of the power supply potential output section through the second switch, is formed. Hereby, the amount of the current which instantly flows to the reference potential node from the output terminal of the power supply potential output section, is reduced more, and the instant decrease amount of the first power supply potential becomes smaller. Therefore, the reverse direction current which flows to the rectifying device, becomes smaller, and the concern such as the damage of the rectifying device, can be reduced more.

(5) In the liquid discharge apparatus, when a potential difference between the second switch drive signal and the reference potential is higher than a threshold, the first terminal of the second switch and the second terminal of the second switch may be electrically connected, and when the first power supply potential begins to rise from the reference potential, a potential of the second switch drive signal may also begin to rise.

According to the liquid discharge apparatus, the first power supply potential begins to rise, the potential of the second switch drive signal immediately begins to rise, and the second switch is turned on at the point of time that the potential difference between the second switch drive signal and the reference potential exceeds the threshold. Therefore, when the first power supply potential is lower, the current path which is to the reference potential node from the output terminal of the power supply potential output section through the second switch, is formed. Hereby, the amount of the current which instantly flows to the reference potential node from the output terminal of the power supply potential output section, is reduced more, and the instant decrease amount of the first power supply potential becomes smaller. Therefore, the reverse direction current which flows to the rectifying device, becomes smaller, and the concern such as the damage of the rectifying device, can be reduced more.

(6) In the liquid discharge apparatus, the first power supply potential can be a plurality of potentials including a first potential, a second potential that is higher than the first potential, a third potential that is higher than the second potential, a fourth potential that is higher than the third potential, and a fifth potential that is higher than the fourth potential, the first switch may have an on state, an off state, and an unstable state that can be any one of on or off, the second switch may have an on state, an off state, and an unstable state that can be any one of on or off, the first power supply potential may have a first state where the first power supply potential is at the first potential, the first switch is in the off state, and the second switch is in the on state, a second state where the first power supply potential is at the second potential, the first switch is in the off state, and the second switch is in the unstable state, a third state where the first power supply potential is at the third potential, the first switch is in the off state, and the second switch is in the off state, a fourth state where the first power supply potential is at the fourth potential, the first switch is in the unstable state, and the second switch is in the off state, and a fifth state where the first power supply potential is at the fifth potential, the first switch is in the on state, and the second switch is in the off state, and the state may transit from the first state to the second state, from the second state to the third state, from the third state to the fourth state, and from the fourth state to the fifth state.

(7) In the liquid discharge apparatus, the first power supply potential can further be a plurality of potentials including a sixth potential that is higher than the fifth potential, a seventh potential that is higher than the sixth potential, an eighth potential that is higher than the seventh potential, a ninth potential that is higher than the eighth potential, a tenth potential that is higher than the ninth potential, an eleventh potential that is higher than the tenth potential, a twelfth potential that is higher than the eleventh potential, and a thirteenth potential that is higher than the twelfth potential, the first power supply potential may further have a sixth state where the first power supply potential is at the sixth potential, the first switch is in the on state, and the second switch is in the off state, a seventh state where the first power supply potential is at the seventh potential, the first switch is in the unstable state, and the second switch is in the off state, an eighth state where the first power supply potential is at the eighth potential, the first switch is in the off state, and the second switch is in the off state, a ninth state where the first power supply potential is at the ninth potential, the first switch is in the off state, and the second switch is in the unstable state, a tenth state where the first power supply potential is at the tenth potential, the first switch is in the off state, and the second switch is in the on state, an eleventh state where the first power supply potential is at the eleventh potential, the first switch is in the off state, and the second switch is in the on state, a twelfth state where the first power supply potential is at the twelfth potential, the first switch is in the off state, and the second switch is in the unstable state, and a thirteenth state where the first power supply potential is at the thirteenth potential, the first switch is in the off state, and the second switch is in the off state, and the state may further transit from the fifth state to the sixth state, from the sixth state to the seventh state, from the seventh state to the eighth state, from the eighth state to the ninth state, from the ninth state to the tenth state, from the tenth state to the eleventh state, from the eleventh state to the twelfth state, and from the twelfth state to the thirteenth state.

BRIEF DESCRIPTION OF THE DRAWINGS

The invention will be described with reference to the accompanying drawings, wherein like numbers reference like elements.

DESCRIPTION OF EXEMPLARY EMBODIMENTS

1. First Embodiment

As an embodiment of a liquid discharge apparatus of the invention, a liquid ejecting type printing apparatus to which the invention is applied, will be described.

1.1. Configuration of a Printing System

Figure 1:
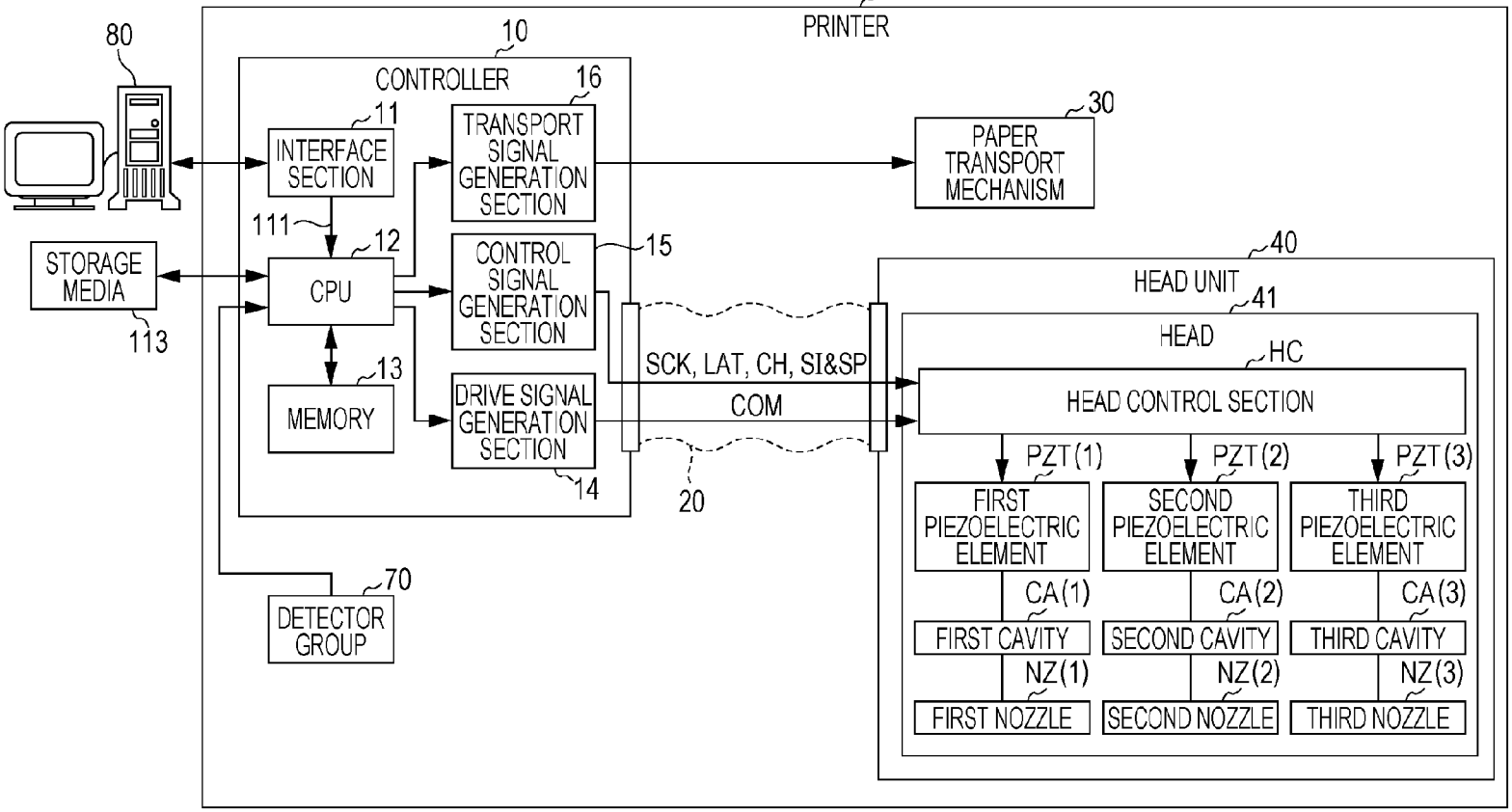
FIG. 1 is a block diagram illustrating an overall configuration of a printing system.

FIG. 1 is a block diagram illustrating an overall configuration of a printing system including a liquid ejecting type printing apparatus (printer 1) according to a first embodiment. As described later, the printer 1 is a line head printer in which a paper S (see FIG. 2 and FIG. 3) is transported in a predetermined direction, and is printed in a printing region during the transport thereof.

The printer 1 is communicatably connected to a computer 80, and a printer driver which is installed within the computer 80, makes out printing data in order to print an image with the printer 1, and outputs to the printer 1. The printer 1 has a controller 10, a paper transport mechanism 30, a head unit 40, and a detector group 70. Moreover, the printer 1 may include a plurality of the head units 40, but here, it will be described showing FIG. 1 which is represented by one head unit 40.

The controller 10 within the printer 1 is used in order to perform overall control of the printer 1. An interface section 11 performs transmission and reception of the data between the printer 1 and the computer 80 which is an external apparatus. Therefore, the interface section 11 outputs a printing data 111 among the data which is received from the computer 80, to a CPU 12. The printing data 111 includes, for example, image data, the data designating a printing mode, or the like.

The CPU 12 is an arithmetic processing apparatus for performing the overall control of the printer 1, and controls the head unit 40 and the paper transport mechanism 30 through a drive signal generation section 14, a control signal generation section 15, and a transport signal generation section 16. A memory 13 is used in order to secure a region storing a program and the data of the CPU 12, a work region, or the like. A state within the printer 1 is monitored by the detector group 70, and the controller 10 performs the control on the basis of a detection result from the detector group 70. The program and the data of the CPU 12, may be stored in a storage media 113. For example, the storage media 113 may be any one of a magnetic disk such as a hard disk, an optical disk such as a DVD, and a nonvolatile memory such as a flash memory, but is not particularly limited. As FIG. 1, the CPU 12 may access the storage media 113 which is connected to the printer 1. Furthermore, the storage media 113 is connected to the computer 80, and the CPU 12 may access the storage media 113 through the interface section 11 and the computer 80 (a path is not shown).

The drive signal generation section 14 generates a drive signal COM in which a piezoelectric element PZT included in a head 41 is displaced. As described later, the drive signal generation section 14 includes a portion of an original drive signal generation section 25, a signal modulation section 26, a signal amplification section (digital power amplification circuit) 28, and a signal conversion section (smoothing filter) 29 (see FIG. 7). According to an instruction from the CPU 12, the drive signal generation section 14 generates an original drive signal 125 with the original drive signal generation section 25, generates a modulation signal 126 by pulse-modulating the original drive signal 125 with the signal modulation section 26, and generates the drive signal COM by amplifying the modulation signal 126 with the signal amplification section 28 and by smoothing an amplification modulation signal 128 (the modulation signal 126 which is amplified) with the signal conversion section 29.

The control signal generation section 15 generates a control signal according to the instruction from the CPU 12. For example, the control signal is a signal which is used for such the control of the head 41 as selecting a nozzle to eject.

In the embodiment described herein, the control signal generation section 15 generates the control signal including a clock signal SCK, a latch signal LAT, a channel signal CH, and drive pulse selection data SI & SP, but the signals will be described later in detail. Moreover, the control signal generation section 15 may be configured to be included in the CPU 12 (that is, the configuration where the CPU 12 also doubles as a function of the control signal generation section 15).

Here, the drive signal COM which the drive signal generation section 14 generates, is an analog signal of which a voltage continuously changes, and the clock signal SCK, the latch signal LAT, the channel signal CH, and the drive pulse selection data SI&SP which are the control signal, are digital signals. The drive signal COM and the control signal are transmitted to the head 41 of the head unit 40 through a cable 20 which is a flexible flat cable (hereinafter, also referred to as FFC). Regarding the control signal, a plurality of kinds of the signals may be transmitted by time division using a differential serial method. At this time, in comparison with the case of transmitting the control signal in parallel for each kind, it is possible to reduce the number of necessary transmission lines, a decrease in sliding properties by superposition of a lot of FFCs is avoided, and a size of a connector which is arranged in the controller 10 and the head unit 40, also becomes small.

According to the instruction from the CPU 12, the transport signal generation section 16 generates the signal that controls the paper transport mechanism 30. For example, the paper transport mechanism 30 rotatably supports the paper S which is wound in a roll shape and continues, transports the paper S by a rotation, and makes a predetermined character and an image be printed in the printing region. For example, the paper transport mechanism 30 transports the paper S in a predetermined direction, on the basis of the signal which is generated by the transport signal generation section 16. Moreover, the transport signal generation section 16 may be configured to be included in the CPU 12 (that is, the configuration where the CPU 12 also doubles as the function of the transport signal generation section 16).

The head unit 40 includes the head 41 as a liquid discharge section. For lack of space, in FIG. 1, only one head 41 is shown, but the head unit 40 of the embodiment described herein, may include the plurality of the heads 41. The head 41 includes an actuator section including the piezoelectric element PZT, a cavity CA, and a nozzle NZ, and also includes a head control section HC that controls a displacement of the piezoelectric element PZT. The actuator section includes the piezoelectric element PZT which can be displaced by the drive signal COM, the cavity CA of which a liquid is filled inside, and an internal pressure is increased and decreased by the displacement of the piezoelectric element PZT, the nozzle NZ which is communicated with the cavity CA, and discharges the liquid as a liquid droplet by the increase and decrease of the pressure within the cavity CA. The head control unit HC controls the displacement of the piezoelectric element PZT, based on the drive signal COM and the control signal from the controller 10.

Here, in the case of distinguishing between components included in each actuator section, it is assumed that the numbers in parentheses are attached to the reference signs. In the example of FIG. 1, there are the three actuator sections. A first actuator section includes a first piezoelectric element PZT (1), a first cavity CA (1), and a first nozzle NZ (1), and a second actuator section includes a second piezoelectric element PZT (2), a second cavity CA (2), and a second nozzle NZ (2). A third actuator section includes a third piezoelectric element PZT (3), a third cavity CA (3), and a third nozzle NZ (3). Furthermore, the actuator sections are not limited to three, for example, the actuator section may be one or two, or may be four or more. Moreover, in FIG. 1, for lack of space, the first actuator section to the third actuator section are included in one head 41, but the portion thereof may also be included in another head 41 which is not shown in the drawing.

The drive signal COM is generated by the drive signal generation section 14 as shown in FIG. 1, and is passed down to the first piezoelectric element PZT (1), the second piezoelectric element PZT (2), and the third piezoelectric element PZT (3) through the cable 20 and the head control section HC. Furthermore, the control signal including the clock signal SCK, the latch signal LAT, the channel signal CH, and the drive pulse selection data SI & SP, is generated by the control signal generation section 15 as shown in FIG. 1, and is used for the control in the head control section HC, through the cable 20.

1.2. Configuration of the Printer

Figure 2:
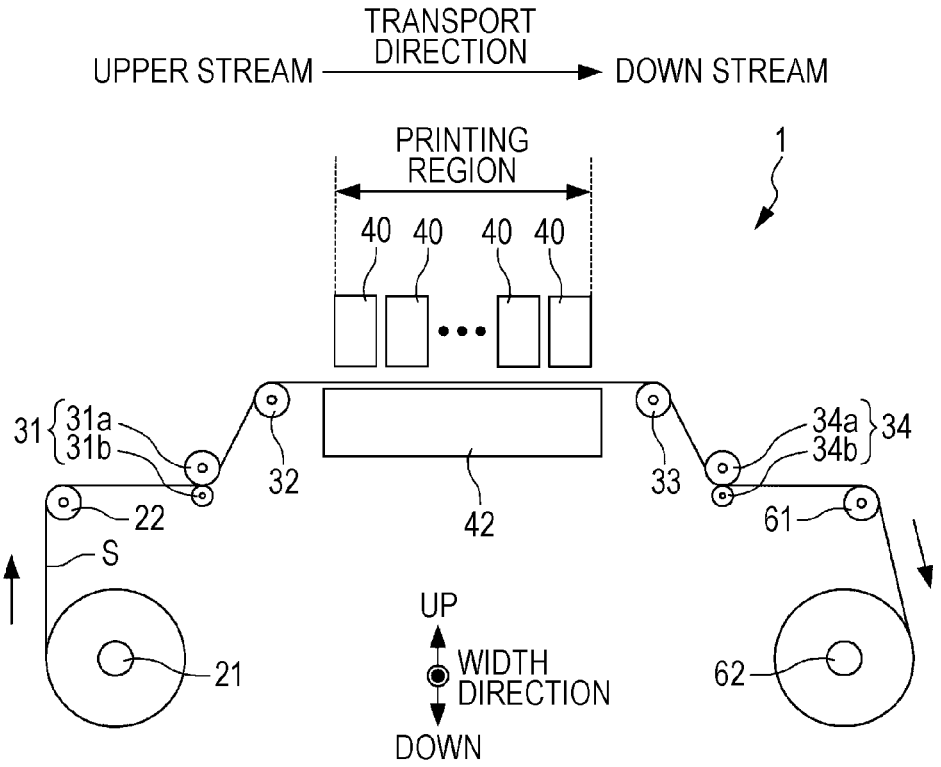
FIG. 2 is a schematic cross-sectional view of a printer.

FIG. 2 is a schematic cross-sectional view of the printer 1. In the example of FIG. 2, the paper S will be described as a continuous sheet wound in a roll shape, but a recording medium on which the printer 1 prints the image is not limited to the continuous sheet, and may be a cut sheet, cloth, a film or the like.

The printer 1 has a winding shaft 21 that feeds the paper S by the rotation, and a relay roller 22 that winds up the paper S which is fed from the winding shaft 21 and guides to a pair of upper stream side transport rollers 31. The printer 1 has a plurality of relay rollers 32 and 33 which wind up and send the paper S, the pair of the upper stream side transport rollers 31 which are arranged on an upper stream side of a transport direction than the printing region, and a pair of down stream side transport rollers 34 which are arranged on a further down stream side of the transport direction than the printing region. The pair of the upper stream side transport rollers 31 and the pair of the down stream side transport rollers 34 have drive rollers 31*a* and 34*a* which are connected to a motor (not shown) and drive and rotate, and driven rollers 31*b* and 34*b* which rotate along the rotation of the drive rollers 31*a* and 34*a*, respectively. Therefore, transport force is given to the paper S by the drive rollers 31*a* and 34*a* are driven and rotated in the state where the pair of the upper stream side transport rollers 31 and the pair of the down stream side transport rollers 34 pinch the paper S therebetween, respectively. The printer 1 has a relay roller 61 that winds up and sends the paper S which is sent from the pair of the down stream side transport rollers 34, and a winding drive shaft 62 that winds the paper S which is sent from the relay roller 61. The paper S in which the printing is finished along a rotary drive of the winding drive shaft 62, is sequentially wound in a roll shape. Moreover, the rollers and the motor which is not shown in the drawings, correspond to the paper transport mechanism 30 of FIG. 1.

The printer 1 has the head unit 40, and a platen 42 that supports the paper S from an opposite side face of a printing face in the printing region. The printer 1 may install the plurality of the head units 40 thereon. For example, the printer 1 may prepare the head unit 40 for each color of inks, and may be configured to arrange the four head units 40 that can discharge four colors of inks of yellow (Y), magenta (M), cyan (C), and black (K) in the transport direction. Furthermore, in the following description, there is the description which is represented by one head unit 40, but it is assumed that color printing in which the colors of inks are assigned with respect to each nozzle can be performed.

Figure 3:
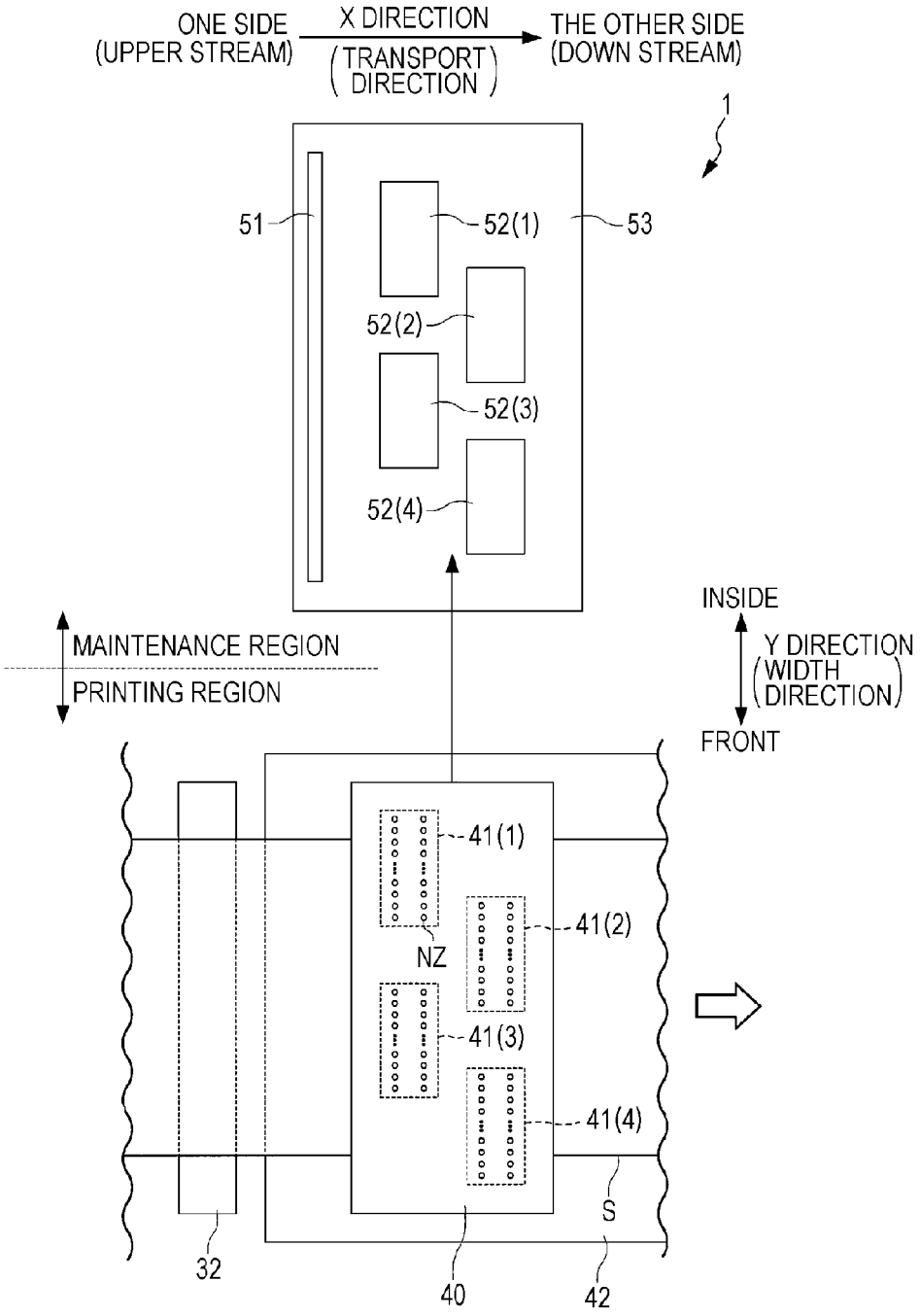
FIG. 3 is a schematic top view of the printer.

As shown in FIG. 3, in the head unit 40, the plurality of the heads 41(1) to 41(4) are arranged in a width direction (Y direction) of the paper S intersecting with the transport direction of the paper S. For the description, low numbers are sequentially attached from the head 41 on the inside of the Y direction. Furthermore, in an opposed face (lower face) of the paper S in each head 41, the plurality of the nozzles NZ that discharge the inks, are arranged at a predetermined gap in the Y direction. In FIG. 3, a position of the head 41 and the nozzle NZ is virtually shown when the head unit 40 is seen from above. The positions of the nozzles NZ at end sections of the adjacent heads 41 (for example, 41(1) and 41(2)) in the Y direction, are the position where the portions thereof are overlapped at least, and in the lower face of the head unit 40, over a width length or more of the paper S, the nozzles NZ are arranged at the predetermined gap in the Y direction. Accordingly, the head unit 40 discharges the ink from the nozzle NZ with respect to the paper S which is transported without stopping a bottom of the head unit 40, and thereby a two-dimensional image is printed on the paper S.

In FIG. 3, for lack of space, the four head 41 belonging to the head unit 40 is shown, but it is not limited thereto. That is, the head 41 may be more than four or less than four. Furthermore, the heads 41 in FIG. 3 are arranged in a hound's-tooth check shape, but are not limited to the arrangement. Here, in the embodiment described herein, an ink discharge method from the nozzle NZ is a piezo method which discharges the ink by applying the voltage to the piezoelectric element PZT and expanding and contracting an ink chamber, but may be a thermal method which generates bubbles within the nozzle NZ using a heating element and discharges the ink by the bubbles.

Furthermore, in the embodiment described herein, there is the configuration that the paper S is supported by a horizontal face of the platen 42, but it is not limited thereto. For example, there may be the configuration that a rotating drum that rotates using the width direction of the paper S as a rotation axis, is made as the platen 42, and the ink is discharged from the head 41 while transporting the paper S wound up by the rotating drum. In this case, the head unit 40 is arranged to be inclined along an outer circumferential face of the rotating drum having an arc shape. Moreover, for example, in the case that the ink which is discharged from the head 41 is an UV ink which is cured by irradiating with ultraviolet rays, an irradiator that irradiates the ultraviolet rays may be arranged on the down stream side of the head unit 40.

Here, the printer 1 is provided with a maintenance region for performing cleaning of the head unit 40. In the maintenance region of the printer 1, a wiper 51, a plurality of caps 52, and an ink receiving section 53 are present. The maintenance region is positioned on the further inside of the Y direction than the platen 42 (that is, printing region), and the head unit 40 moves to the inside of the Y direction at the time of cleaning.

The wiper 51 and the caps 52 are supported with the ink receiving section 53, and are movable in the X direction (transport direction of the paper S) by the ink receiving section 53. The wiper 51 is a member having a plate shape which is found to stand from the ink receiving section 53, and is formed of an elastic member, fabric, felt or the like. The cap 52 is the member of a rectangular parallelepiped that is formed of the elastic member or the like, and is arranged on each head 41. Therefore, in accordance with the arrangement of the heads 41(1) to 41(4) in the head unit 40, the caps 52(1) to 52(4) are also arranged in the width direction. Accordingly, the head unit 40 moves to the inside of the Y direction, and the head 41 and the cap 52 are opposed. The head unit 40 falls (or the cap 52 rises), the cap 52 is stuck to a nozzle opening face of the head 41, and it is possible to seal the nozzle NZ. The ink receiving section 53 also takes a role for receiving the ink which is discharged from the nozzle NZ at the time of cleaning the head 41.

When the ink is discharged from the nozzle NZ which is arranged in the head 41, a minute ink droplet in company with a main ink droplet are generated. The minute ink droplet flies high up as a mist, and adheres to the nozzle opening face of the head 41. Furthermore, not only the ink but also dust, paper powder, and the like are attached, to the nozzle opening face of the head 41. If it is left alone and accumulated while the foreign materials are attached to the nozzle opening face of the head 41, the nozzle NZ is blocked up, and an ink discharge from the nozzles NZ, is hindered. Accordingly, in the printer 1 of the embodiment described herein, a wiping processing is periodically performed as a cleaning of the head unit 40.

1.3. Drive Signal and Control Signal

Hereinafter, the drive signal COM and the control signal from the controller 10 which are transmitted with the cable 20, will be described in detail. First, a structure of the head 41 will be described, and a waveform of the drive signal COM and the control signal is illustrated. Thereafter, the configuration of the head control section HC will be described.

1.3.1. Structure of the Head

Figure 4:
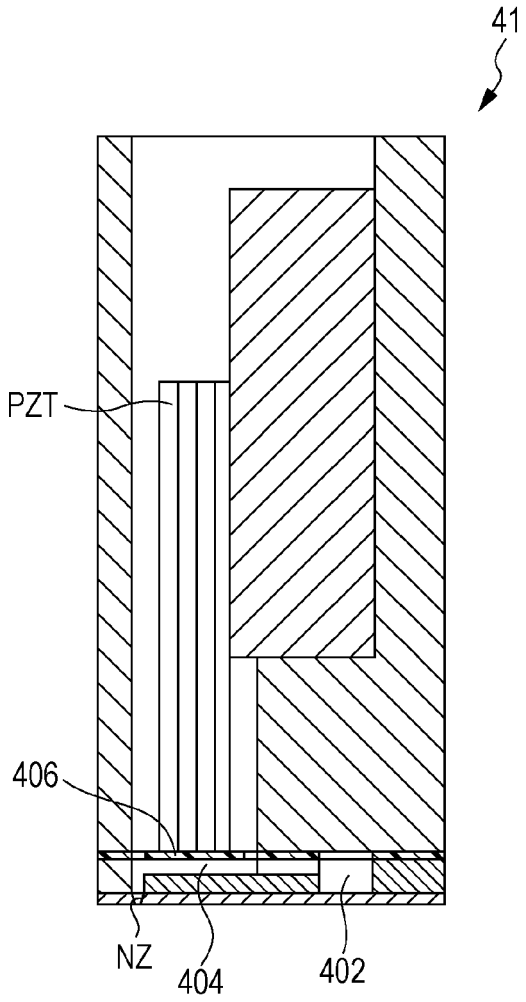
FIG. 4 is a diagram for describing a structure of a head.

FIG. 4 is a diagram for describing the structure of the head 41. In FIG. 4, the nozzle NZ, the piezoelectric element PZT, an ink supply path 402, a nozzle communication path 404, and an elastic plate 406, are shown. The ink supply path 402 and the nozzle communication path 404 correspond to the cavity CA.

To the ink supply path 402, the ink droplet is supplied from an ink tank which is not shown in the drawing. Then, the ink droplet is supplied to the nozzle communication path 404. To the piezoelectric element PZT, a drive pulse PCOM of the drive signal COM is applied. The drive pulse PCOM is applied, the piezoelectric element PZT is expanded and contracted (displaced) according to the waveform, and the elastic plate 406 is vibrated. Therefore, the ink droplet of an amount corresponding to amplitude of the drive pulse PCOM, is made so as to be discharged from the nozzle NZ. The actuator section which is made up of the nozzle NZ, the piezoelectric element PZT and the like, is arranged as shown in FIG. 3, and configures the head 41 having a nozzle row.

1.3.2. Waveform of the Signal

Figure 5:
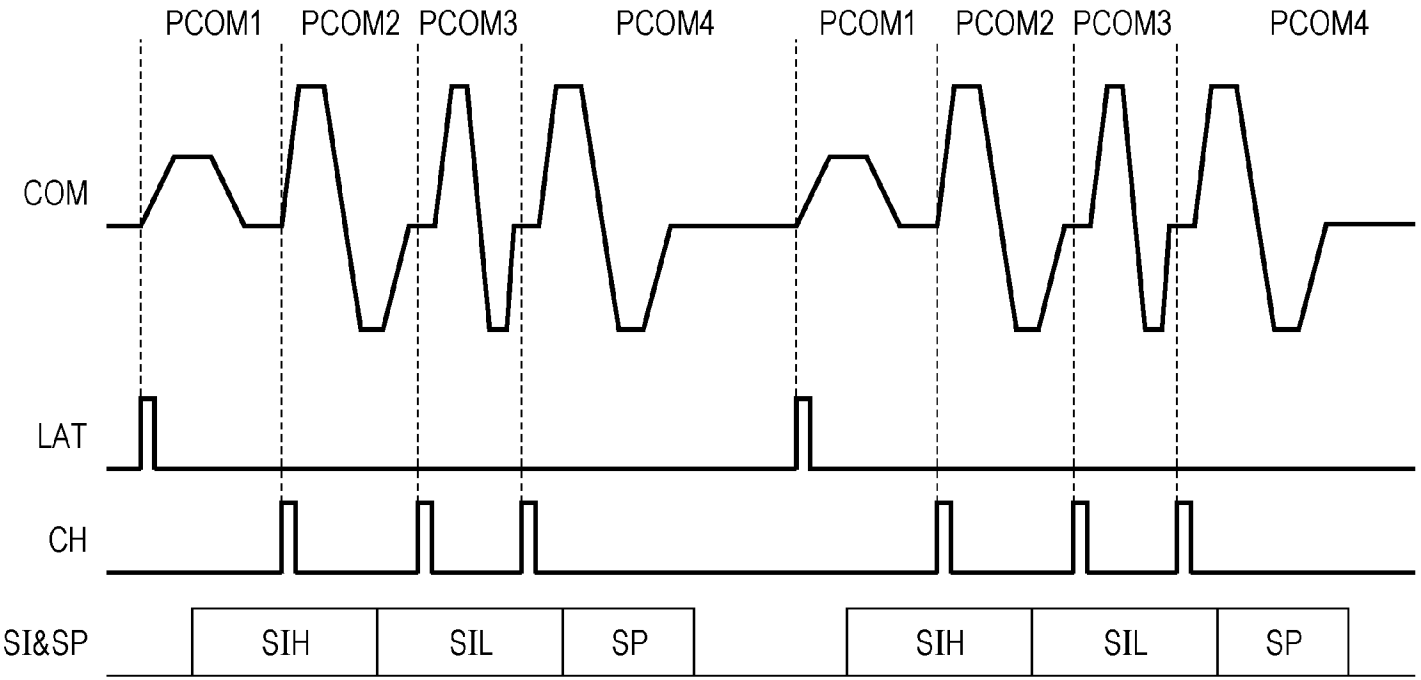
FIG. 5 is a diagram for describing a drive signal COM from a drive signal generation section and a control signal which is used in dot formation.

FIG. 5 is a diagram for describing the drive signal COM from the drive signal generation section 14 and the control signal which is used in dot formation. The drive signal COM is connected in time series, to the drive pulse PCOM as a unit drive signal which is applied to the piezoelectric element PZT and makes the liquid to be ejected. There are a stage that a rising portion of the drive pulse PCOM expands a volume of the cavity CA which is communicated with the nozzle, and pulls the liquid in, and the stage that a falling portion of the drive pulse PCOM reduces the volume of the cavity CA, and pushes the liquid out. As the result of pushing the liquid out, the liquid is ejected from the nozzle.

By variously modifying an inclination of voltage increase and decrease and a peak value in the drive pulse PCOM which is made up of a voltage trapezoid wave, a pulling-in amount and a pulling-in speed of the liquid, and a pushing-out amount and a pushing-out speed of the liquid, can be varied. Hereby, an ejecting amount of the liquid is varied, and it is possible to obtain dots of different sizes. Accordingly, even when the plurality of the drive pulses PCOM are connected in time series, by selecting single drive pulse PCOM from among them, applying to the piezoelectric element PZT, and ejecting the liquid, or by selecting the plurality of the drive pulses PCOM, applying to the piezoelectric element PZT, and ejecting the liquid plural times, it is possible to obtain the dots of various sizes. That is, if the liquid is impacted on the same position plural times while the liquid does not dry, it is substantially the same as to eject a large amount of the liquid, and it is possible to make the size of the dot to be large. By a combination of the technology described above, it is possible to achieve multistage gradation. Moreover, a drive pulse PCOM1 at a left end of FIG. 5, is different from drive pulses PCOM2 to PCOM4, and is only to pull the liquid in, but is not to push the liquid out. This is referred to as a minute vibration, and is used to suppress and prevent thickening of the nozzle without ejecting the liquid.

To the head control section HC, other than the drive signal COM from the drive signal generation section 14, as a control signal from the control signal generation section 15, the clock signal SCK, the latch signal LAT, the channel signal CH, and the drive pulse selection data SI&SP, are input. Among them, the latch signal LAT and the channel signal CH are control signals which fix timing of the drive signal COM. As shown in FIG. 5, the series of the drive signal COM begin to be output with the latch signal LAT, and the drive pulse PCOM is made to be output for each channel signal CH. The drive pulse selection data SI&SP includes a pixel data SI (SIH, SIL) which designates the piezoelectric element PZT corresponding to the nozzle which ought to discharge the ink droplet, and a waveform pattern data SP of the drive signal COM. The SIH and SIL correspond to a high-order bit and a low-order bit of the pixel data SI of two bits, respectively.

1.3.3. Head Control Section

Figure 6:
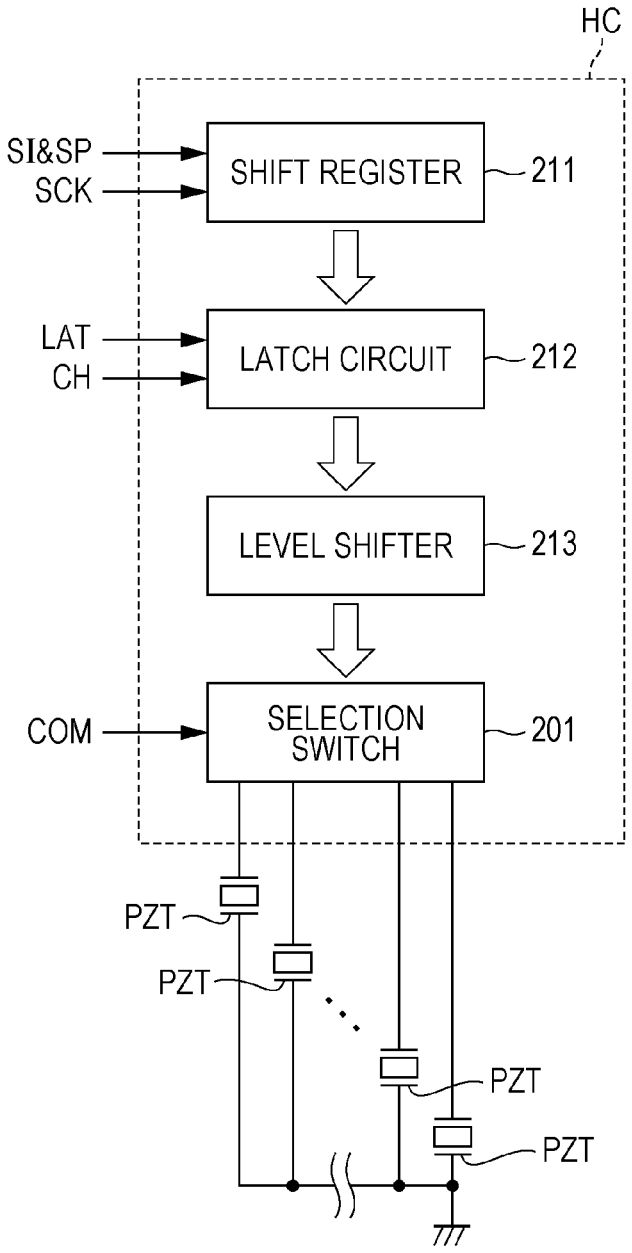
FIG. 6 is a block diagram describing a configuration of a head control section.

FIG. 6 is a block diagram describing the configuration of the head control section HC. The head control section HC is configured to include a shift register 211 that stores the drive pulse selection data SI&SP for designating the piezoelectric element PZT corresponding to the nozzle to eject the liquid, a latch circuit 212 that temporarily stores the data of the shift register 211, and a level shifter 213 that applies the voltage of the drive signal COM to the piezoelectric element PZT, by level-converting the output of the latch circuit 212, and supplying to a selection switch 201.

To the shift register 211, the drive pulse selection data SI&SP is sequentially input, and a storage region is sequentially shifted to a subsequent stage from a first stage according to an input pulse of the clock signal SCK. After the drive pulse selection data SI&SP of the amount of several nozzles is stored in the shift register 211, the latch circuit 212 latches each output signal of the shift register 211 by the latch signal LAT which is input. The signal which is stored in the latch circuit 212, is converted to a voltage level that can turn on and off the selection switch 201 of a next stage, by the level shifter 213. This is because the drive signal COM is a high voltage in comparison with the output voltage of the latch circuit 212, and an operation voltage range of the selection switch 201 is also set to be high in accordance therewith. Accordingly, the piezoelectric element PZT where the selection switch 201 is closed by the level shifter 213, is connected to the drive signal COM (drive pulse PCOM) at the connection timing of the drive pulse selection data SI&SP.

Furthermore, after the drive pulse selection data SI&SP of the shift register 211 is stored in the latch circuit 212, next printing information is input to the shift register 211, and the data which is stored in the latch circuit 212, is sequentially updated in accordance with the ejecting timing of the liquid. Moreover, by the selection switch 201, even after cutting the piezoelectric element PZT off from the drive signal COM (drive pulse PCOM), an input voltage of the piezoelectric element PZT is maintained at the voltage just before cutting off.

1.3.4. Drive Signal

Figure 7:
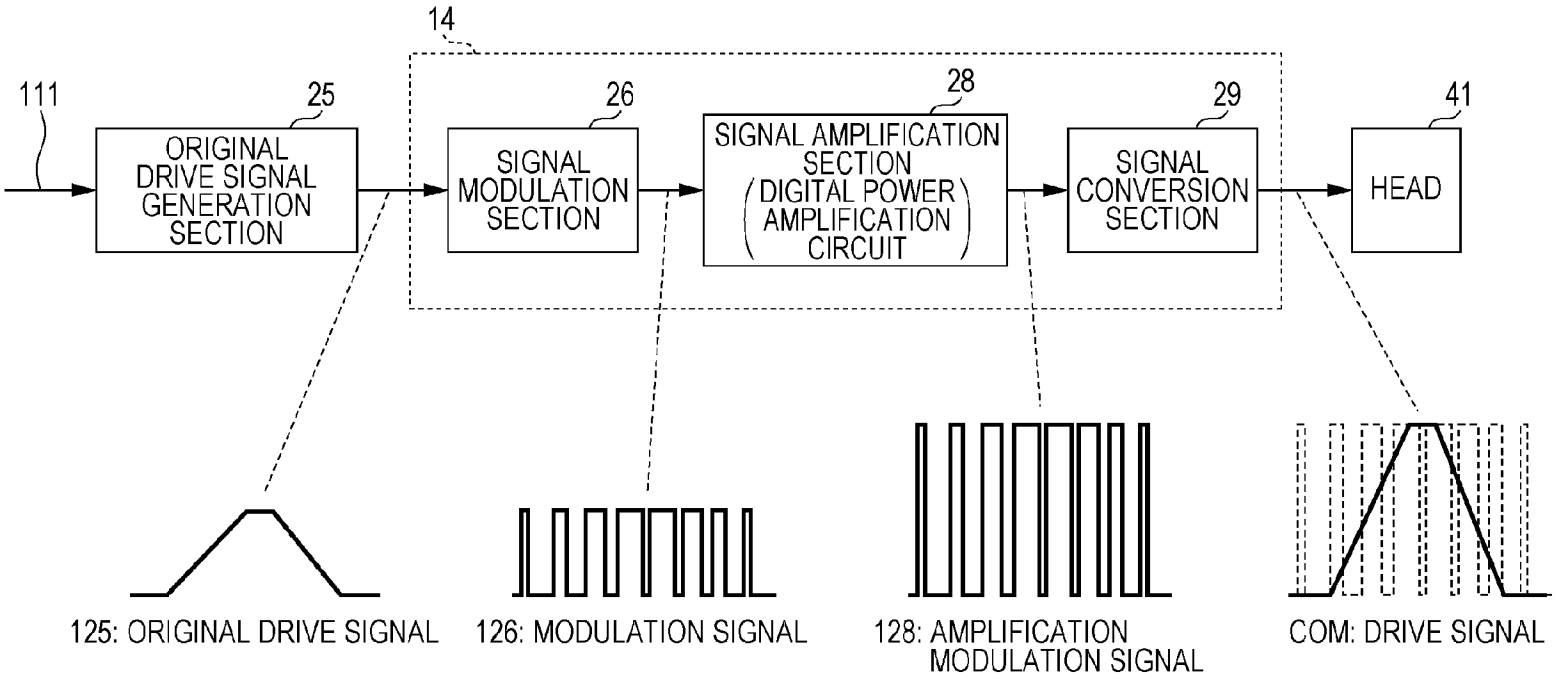
FIG. 7 is a diagram describing a flow up to generation of the drive signal COM.

FIG. 7 is a diagram describing a flow up to generation of the drive signal COM. As described above, a portion of the original drive signal generation section 25, the signal modulation section 26, the signal amplification section 28 (digital power amplification circuit), and the signal conversion section 29 (smoothing filter) of FIG. 7, correspond to the drive signal generation section 14. The original drive signal generation section 25 generates, for example, the original drive signal 125 as shown in FIG. 7, on the basis of the printing data 111 from the interface section 11.

The original drive signal generation section 25 includes the CPU 12, a DAC 39, and the like as described later, and generates the original drive signal 125, from that the CPU selects original drive data on the basis of the printing data 111 and outputs to the DAC 39.

The signal modulation section 26 receives the original drive signal 125 from the original drive signal generation section 25, and generates the modulation signal 126 by performing a predetermined modulation. The predetermined modulation is a pulse density modulation (PDM) in the embodiment described herein, but, for example, other modulation methods such as a pulse width modulation (PWM), may be used.

The signal amplification section 28 generates the amplification modulation signal 128 by receiving the modulation signal 126 and power-amplifying, and the signal conversion section 29 generates the analog drive signal COM where the portion modulated to a large pulse width has a high voltage value, and the portion modulated to a narrow pulse width has a low voltage value, by smoothing the amplification modulation signal 128.

1.4. Configuration of the Drive Signal Generation Section

Figure 8:
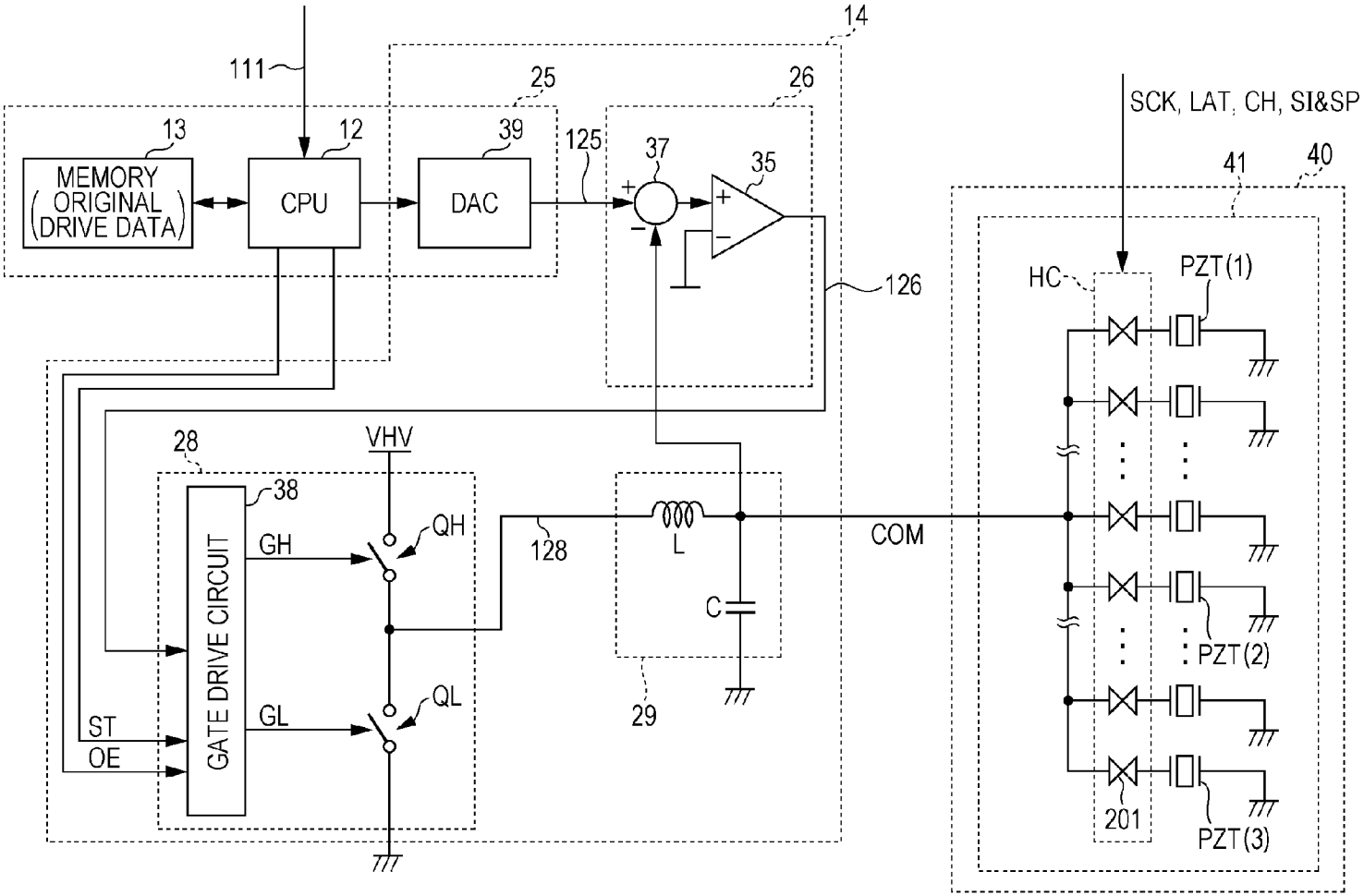
FIG. 8 is a detailed block diagram of the drive signal generation section or the like according to a first embodiment.

FIG. 8 is a detailed block diagram of the drive signal generation section 14 or the like of the printer 1 according to the embodiment described herein. The head 41 includes many piezoelectric elements PZT corresponding to the nozzle. For example, the first piezoelectric element PZT (1), the second piezoelectric element PZT (2), and the third piezoelectric element PZT (3) which are shown in FIG. 8, correspond to the three piezoelectric elements of FIG. 1, but are the portion of the whole piezoelectric elements (for example, several thousands). In the embodiment described herein, the drive signal COM can be applied to the whole piezoelectric elements PZT including the first piezoelectric element PZT (1), the second piezoelectric element PZT (2), and the third piezoelectric element PZT (3). Furthermore, in FIG. 8, an illustration of the cavity CA and the nozzle NZ is omitted.

Moreover, as shown in FIG. 8, the head 41 includes the head control section HC, and the head control section HC includes the selection switch 201 that selects whether the voltage of the drive signal COM is applied to each piezoelectric element PZT. In FIG. 8, the illustration of functional blocks (for example, the shift register 211 and the like, see FIG. 6) other than the selection switch 201 of the head control section HC, is omitted.

Here, the amplification modulation signal 128 that is generated by the signal amplification section 28, becomes the drive signal COM through the signal conversion section 29 which is realized with a low pass filter combined with a coil L and a capacitor C, but the drive signal COM is necessary to be able to drive the whole piezoelectric elements PZT (for example, several thousands), and the amplification modulation signal 128 is sufficiently amplified by the signal amplification section 28.

The original drive signal generation section 25 includes the memory 13 that stores the original drive data of the original drive signal 125 which is configured of digital potential data or the like, the CPU 12 that reads the original drive data from the memory 13 on the basis of the printing data 111 from the interface section 11, converts the data into a voltage signal, and holds the amount of a predetermined sampling period, and the DAC 39 that analog-converts the voltage signal which is output from the CPU 12, and outputs as an original drive signal 125. Furthermore, the CPU 12 outputs an output enable signal OE and an oscillation start signal ST, toward a gate drive circuit 38 which is described later in the signal amplification section 28.

The signal modulation section 26 is a pulse density modulation (PDM) circuit, and includes an error amplifier 37 that amplifies the amount of a difference between the original drive signal 125 which is output from the DAC 39 and the drive signal COM, and a comparator 35 that compares the potential of the signal which is output from the error amplifier 37 with a predetermined potential, and generates the modulation signal 126 which is pulse-density-modulated. Basic principles and features thereof are similar to a ΔΣ modulator which is configured of a quantizer, a delayer, and an integrator. As the features of the ΔΣ modulator, it is used as an example that since an error (quantization noise) which is generated by the quantizer by two characteristics such as over sampling and noise shaping is driven away to a frequency band which is higher than an input signal, accuracy with respect to a low frequency signal is good, and the quantization noise which is driven away to the high frequency band is distributed to a broadband, and thereby a pulse frequency corresponding to a input signal level is changed. The pulse density modulation method is self-excited oscillated corresponding to the input signal level, and thus, an output voltage range thereof is wide, and it is suitable for a head drive circuit.

However, in the embodiment described herein, the error amplifier 37 is used in place of the integrator which is included in the ΔΣ modulator. Moreover, the comparator 35 which functions as a quantizer has the feature to quantize on the basis of the error between the original drive signal 125 and the drive signal COM. According to the configuration of the embodiment described herein, it is possible to reduce a signal delay due to the comparator 35, the signal amplification section 28, and the signal conversion section 29, and a phase delay due to the signal conversion section 29, by a phase advance correction of the error amplifier 37, and delay time is small and it is suited to a speed up of a circuit, as the integrator is not necessary. Furthermore, the signal modulation section 26 can use the well-known pulse modulation circuit such as the pulse width modulation (PWM) circuit, other than this.

The signal amplification section 28 includes a half bridge output stage that is made up of a first switch QH of a high side for substantially amplifying the power and a second switch QL of a low side, and the gate drive circuit 38 that generates a first switch drive signal GH and a second switch drive signal GL for respectively driving the first switch and the second switch, according to the modulation signal 126 from the signal modulation section 26. As the first switch and the second switch, for example, a power MOSFET can be used, but it is not limited thereto.

In the signal amplification section 28, when the modulation signal 126 is at a high level, the first switch QH is in an on state, and the second switch QL is in an off state. As a result, the voltage of the amplification modulation signal 128 which is output from the half bridge output stage, becomes a power supply potential VHV. On the other hand, when the modulation signal 126 is at a low level, the first switch QH is in the off state, and the second switch QL is in the on state. As a result, the voltage of the amplification modulation signal 128 becomes 0 V.

In this manner, when the first switch QH and the second switch QL are digital-driven, a current flows to the switch of an on state, but if a resistance of the switch is very small, a loss thereof does not nearly occur. Furthermore, since the current does not flow to the switch of an off state, the loss does not occur. Accordingly, the loss itself of the signal amplification section 28 is extremely small, and it is possible to use a switching element such as a small-sized MOSFET in the first switch and the second switch.

The amplification modulation signal 128 that is generated by the signal amplification section 28, becomes the drive signal COM through the signal conversion section 29 which is realized with the low pass filter combined with the coil L and the capacitor C, but is sufficiently amplified by the signal amplification section 28, since it is necessary that the drive signal COM is capable of driving the whole piezoelectric elements PZT (for example, several thousands).

Since the piezoelectric element PZT is a capacitive load, it is not necessary to flow the current when the potential of the drive signal COM (which is the same as the case of the original drive signal 125) does not change. Therefore, in the embodiment described herein, when the potential of the drive signal COM does not change, the CPU 12 makes the output enable signal OE to be at the low level, and the gate drive circuit 38 makes the first switch in company with the second switch to be in the off state when the output enable signal OE is at the low level. If the first switch QH in company with the second switch QL are in the off state, the piezoelectric element PZT which is the capacitive load is maintained in a high impedance state, a charge which is saved in the piezoelectric element PZT is maintained, and a charge and discharge state is maintained or a self discharge is suppressed to be small. In this manner, the first switch in company with the second switch are in the off state when the potential of the drive signal COM does not change, and thereby it is possible to cut down the power which is wastefully consumed in the first switch QH, the second switch QL, and the coil L of the signal conversion section 29.

1.5. Configuration of the Signal Amplification Section

Figure 9:
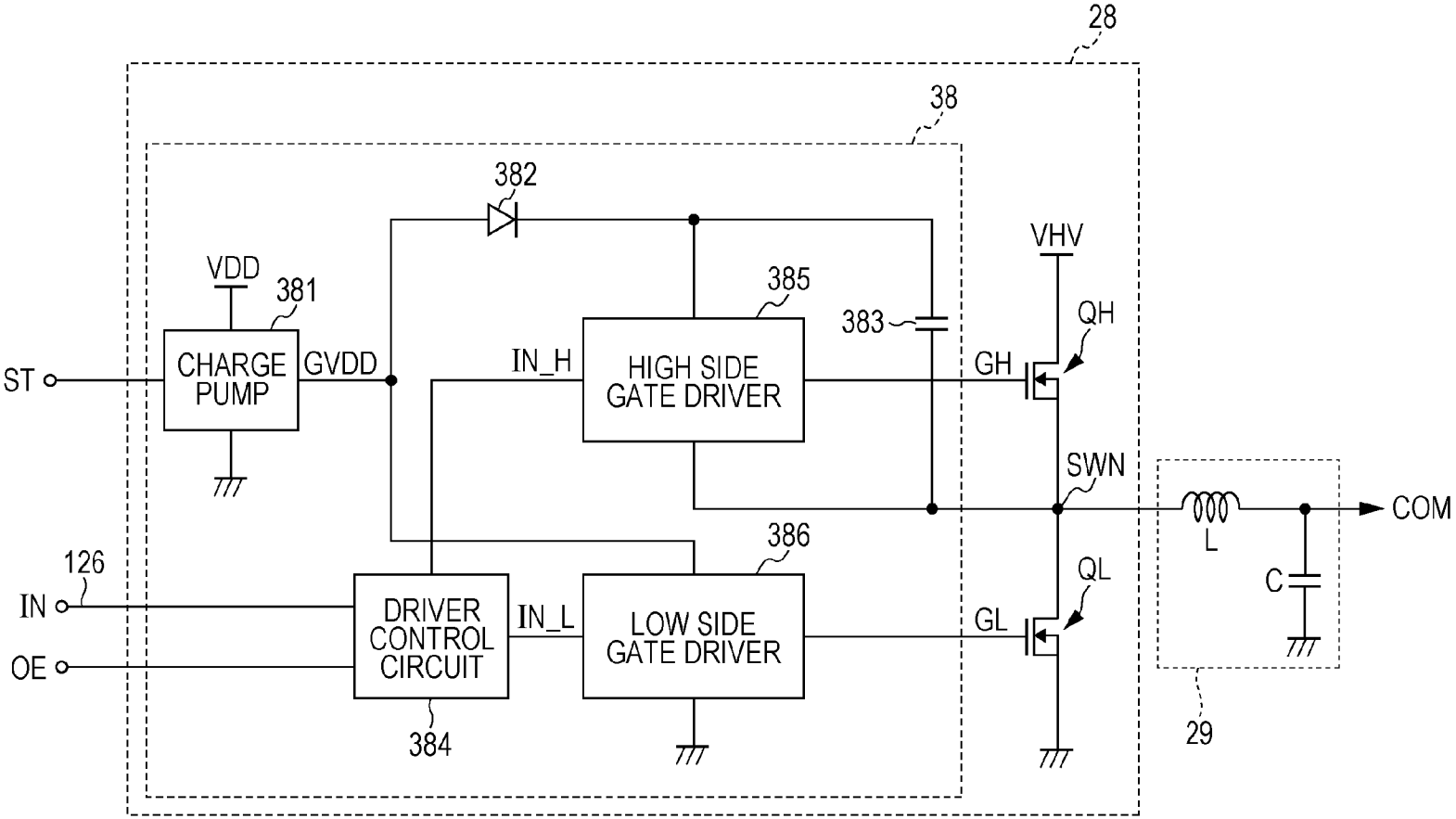
FIG. 9 is a diagram illustrating a circuit configuration example of a signal amplification section according to the first embodiment.

FIG. 9 is a diagram illustrating a circuit configuration example of the signal amplification section 28 of the printer 1 according to the embodiment described herein. In FIG. 9, as the first switch QH and the second switch QL, NMOS transistors are used. To a drain terminal that is a first terminal of the first switch QH, for example, the power supply potential VHV (second power supply potential) of several tens V is supplied, and to a source terminal that is a second terminal of the second switch QL, for example, a reference voltage of 0 V is supplied. The source terminal that is a second terminal of the first switch QH is connected to the drain terminal that is a first terminal of the second switch QL. The first switch QH operates according to the first switch drive signal GH which is input to the gate terminal, and the second switch QL operates according to the second switch drive signal GL which is input to the gate terminal. Therefore, the signal conversion section 29 converts the signal which is generated at a connection node SWN where the source terminal of the first switch QH is electrically connected to the drain terminal of the second switch QL, into the drive signal COM.

The gate drive circuit 38 includes a charge pump 381, a diode 382 that is a rectifying device, a capacitor 383 that is a capacitance element, a driver control circuit 384, a high side gate driver 385, and a low side gate driver 386.

According to the oscillation start signal ST which is input to a terminal from the CPU 12, the charge pump 381 starts to boost the voltage of a power supply potential VDD of 3.3 V, for example. A power supply potential GVDD (first power supply potential) which is output from the output terminal of the charge pump 381, gradually rises from the reference potential (0 V), and reaches a constant potential (for example, 10 V) which is equal to more than a necessary potential difference Vt between the gate and the source for making the first switch and the second switch be in the on state, respectively, for example, in several ms order. The charge pump 381 functions as a power supply potential output section that outputs the power supply potential GVDD of the high side gate driver 385 and the low side gate driver 386.

The diode 382 is arranged between the output terminal of the charge pump 381 and a first terminal of the high side gate driver 385, an anode terminal of the diode 382 is connected to the output terminal of the charge pump 381, and a cathode terminal of the diode 382 is connected to a power supply terminal which is the first terminal of the high side gate driver 385.

The capacitor 383 is arranged between the power supply terminal of the high side gate driver 385 and the connection node SWN of the source terminal of the first switch QH and the drain terminal of the second switch QL, a first terminal of the capacitor 383 is connected to the power supply terminal of the high side gate driver 385, and a second terminal of the capacitor 383 is connected to the connection node SWN. Furthermore, to the connection node SWN, a reference terminal which is a second terminal of the high side gate driver 385, is also connected. The capacitor 383 functions as a bootstrap capacitor.

When the output enable signal OE which is input to an OE terminal from the CPU 12 is at the high level, according to the modulation signal 126 which is input to an IN terminal from the signal modulation section 26, the driver control circuit 384 generates an input signal IN_H of the high side gate driver 385 and an input signal IN_L of the low side gate driver 386. In the embodiment described herein, the driver control circuit 384 makes the input signal IN_H be at the high level, and the input signal IN_L be at the low level when the modulation signal 126 is at the high level. When the modulation signal 126 is at the low level, the driver control circuit 384 makes the input signal IN_H to be at the low level, and the input signal IN_L to be at the high level. Moreover, when the output enable signal OE is at the low level, the driver control circuit 384 makes the input signal IN_H in company with the input signal IN_L be at the low level.

The high side gate driver 385 operates the capacitor 383 that is arranged between the power supply terminal and the reference terminal thereof, as a floating power supply, and generates the first switch drive signal GH according to the input signal IN_H. In the embodiment described herein, the high side gate driver 385 makes the first switch drive signal GH to be at the high level when the input signal IN_H is at the high level, and makes the first switch drive signal GH to be at the low level when the input signal IN_H is at the low level. The high side gate driver 385 functions as a first switch drive section that drives the first switch QH.

The low side gate driver 386 operates by the configuration in which the power supply potential GVDD which the charge pump 381 outputs is supplied to the power supply terminal which is the first terminal and a reference potential (0 V) is supplied to the reference terminal which is the second terminal, and generates the second switch drive signal GL according to the input signal IN_L. In the embodiment described herein, the low side gate driver 386 makes the second switch drive signal GL to be at the high level when the input signal IN_L is at the high level, and makes the second switch drive signal GL to be at the low level when the input signal IN_L is at the low level. The low side gate driver 386 functions as a second switch drive section that drives the second switch QL.

Figure 10:
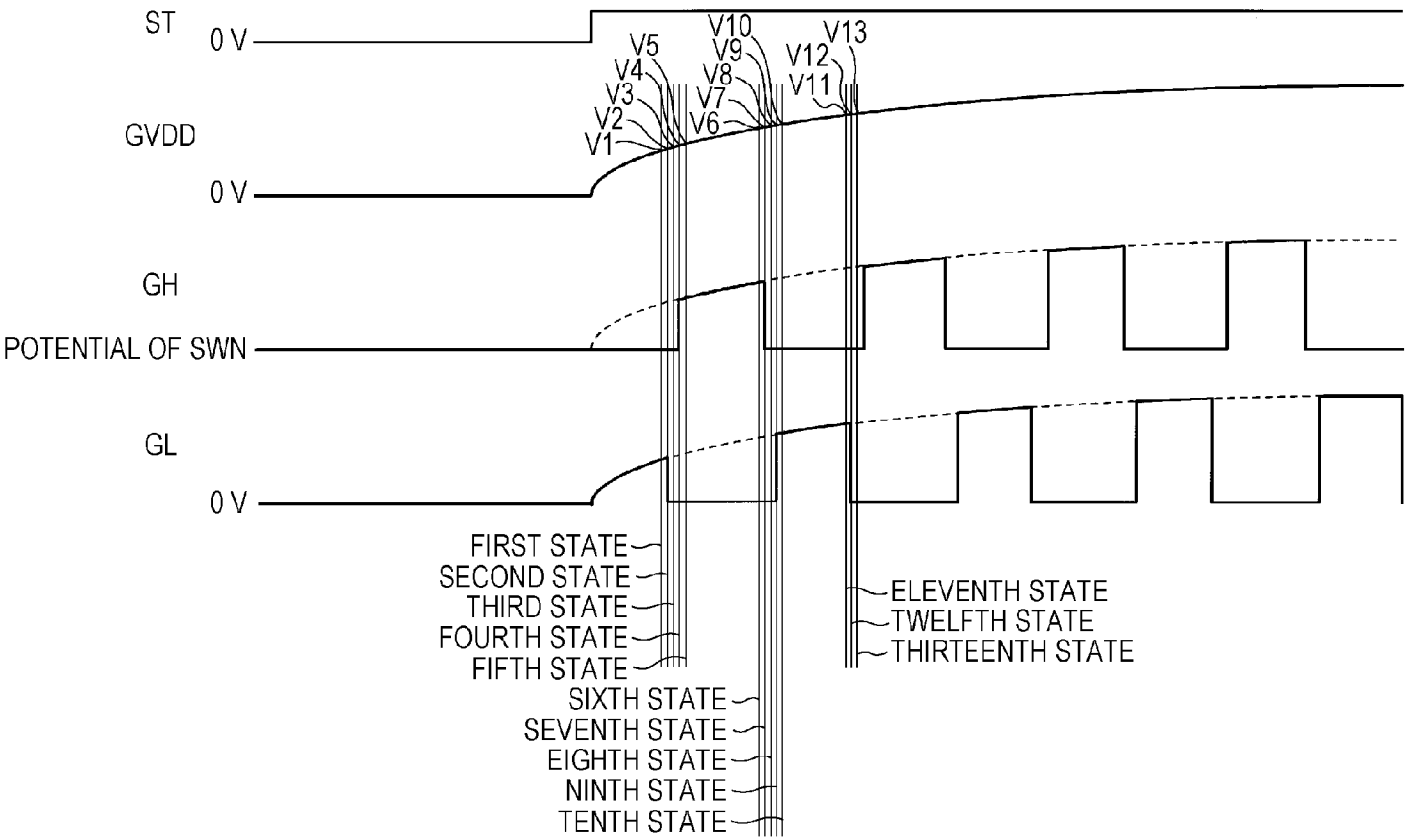
FIG. 10 is a diagram illustrating an example of a signal waveform of the signal amplification section.

FIG. 10 is a diagram illustrating an example of a signal waveform of the signal amplification section 28 when the oscillation start signal ST is input. In the embodiment described herein, when the oscillation start signal ST is at the low level, the modulation signal 126 is made so as to be at the low level, and thereby, the input signal IN_H of the high side gate driver 385 is at the low level, and the input signal IN_L of the low side gate driver 386 is at the high level.

If the oscillation start signal ST changes to the high level from the low level, the charge pump 381 starts to boost the voltage, and the power supply potential GVDD which the charge pump 381 outputs, gradually rises. Since the low side gate driver 386 operates with the power supply potential GVDD, and the input signal IN_L is at the high level, the potential of the second switch drive signal GL gradually rises following the power supply potential GVDD. Therefore, the second switch QL is in the on state where the potential difference between the second switch drive signal GL and the reference potential (0 V) which is the potential difference between the gate and the source, is higher than a predetermined threshold.

Thereupon, from the output terminal of the charge pump 381, through the diode 382, the capacitor 383, and the second switch, the current flows to a reference potential node (ground), and the capacitor 383 is gradually charged by the current. Using the potential of the connection node SWN as a reference, the high side gate driver 385 starts an operation at the power supply potential which is equal to the potential difference between both terminals of the capacitor 383, and the input signal IN_H is at the low level, and thus, the potential of the first switch drive signal GH remains to be equal to the potential of the connection node SWN. Therefore, the first switch QH remains in the off state where the potential difference between the first switch drive signal GH and the potential of the connection node SWN which is the potential difference between the gate and the source, is lower than the threshold.

In this manner, a first state where the power supply potential GVDD gradually rises, the power supply potential GVDD becomes a first potential V1, the first switch QH is in the off state, and the second switch QL is in the on state, occurs. In the first state, the potential of the drive signal COM is the reference voltage (0 V), and the drive signal COM becomes the input of the signal modulation section 26. After the first state, the modulation signal 126 changes to the high level from the low level. Hereby, the input signal IN_L of the low side gate driver 386 changes to the low level from the high level, and thereafter, the input signal IN_H of the high side gate driver 385 changes to the high level from the low level.

If the input signal IN_L is at the low level, the potential of the second switch drive signal GL changes to the reference potential (0 V) from the power supply potential GVDD. At the change point, since the second switch QL is in the state where the potential difference between the gate and the source is lower than the threshold, from the state where the potential difference between the gate and the source is higher than the threshold, the second switch QL is in an unstable state that can be any one of on or off. That is, from the first state, it is transited to a second state where the power supply potential GVDD becomes a second potential V2 which is higher than the first potential V1, the first switch QH is in the off state, and the second switch QL is in the unstable state.

Therefore, if the potential of the second switch drive signal GL becomes the reference potential (0 V), the potential difference between the gate and the source is lower than the threshold, and thus, the second switch QL is in the off state. That is, from the second state, it is transited to a third state where the power supply potential GVDD becomes a third potential V3 which is higher than the second potential V2, the first switch QH is in the off state, and the second switch QL is in the off state.

Thereafter, if the input signal IN_H is at the high level, the potential difference between the first switch drive signal GH and the connection node SWN changes so as to be equal to the potential difference between both terminals of the capacitor 383. At the change point, since the first switch QH is in the state where the potential difference between the gate and the source is higher than the threshold, from the state where the potential difference between the gate and the source is lower than the threshold, the first switch QH is in the unstable state that can be any one of on or off. That is, from the third state, it is transited to a fourth state where the power supply potential GVDD becomes a fourth potential V4 which is higher than the third potential V3, the first switch QH is in the unstable state, and the second switch QL is in the off state.

If the potential difference between the first switch drive signal GH and the connection node SWN is equal to the potential difference between both terminals of the capacitor 383, the potential difference between the gate and the source is higher than the threshold, and thus, the first switch QH is in the on state. That is, from the fourth state, it is transited to a fifth state where the power supply potential GVDD becomes a fifth potential V5 which is higher than the fourth potential V4, the first switch QH is in the on state, and the second switch QL is in the off state.

Thereafter, the power supply potential GVDD rises, and, from the fifth state, it is transited to a sixth state where the power supply potential GVDD becomes a sixth potential V6 which is higher than the fifth potential V5, the first switch QH is in the on state, and the second switch QL is in the off state. In the fifth state and the sixth state, the potential of the drive signal COM becomes the power supply potential VHV (for example, 42 V), and the drive signal COM becomes the input of the signal modulation section 26. After the sixth state, the modulation signal 126 changes to the low level from the high level. Hereby, the input signal IN_H of the high side gate driver 385 changes to the low level from the high level, and thereafter, the input signal IN_L of the low side gate driver 386 changes to the high level from the low level.

If the input signal IN_H is at the low level, the potential of the first switch drive signal GH changes to the potential of the connection node SWN. At the change point, since the first switch QH is in the state where the potential difference between the gate and the source is lower than the threshold, from the state where the potential difference between the gate and the source is higher than the threshold, the first switch QH is in the unstable state that can be any one of on or off. That is, from the sixth state, it is transited to a seventh state where the power supply potential GVDD becomes a seventh potential V7 which is higher than the sixth potential V6, the first switch QH is in the unstable state, and the second switch QL is in the off state.

Therefore, if the potential of the first switch drive signal GH becomes the potential of the connection node SWN, the potential difference between the gate and the source is lower than the threshold, and thus, the first switch QH is in the off state. That is, from the seventh state, it is transited to a eighth state where the power supply potential GVDD becomes an eighth potential V8 which is higher than the seventh potential V7, the first switch QH is in the off state, and the second switch QL is in the off state.

Thereafter, if the input signal IN_L is at the high level, the potential of the second switch drive signal GL changes to the power supply potential GVDD. At the change point, since the second switch QL is in the state where the potential difference between the gate and the source is higher than the threshold, from the state where the potential difference between the gate and the source is lower than the threshold, the second switch QL is in the unstable state that can be any one of on or off. That is, from the eighth state, it is transited to a ninth state where the power supply potential GVDD becomes a ninth potential V9 which is higher than the eighth potential V8, the first switch QH is in the off state, and the second switch QL is in the unstable state.

If the potential of the second switch drive signal GL becomes the power supply potential GVDD, the potential difference between the gate and the source is higher than the threshold, and thus, the second switch QL is in the on state. That is, from the ninth state, it is transited to a tenth state where the power supply potential GVDD becomes a tenth potential V10 which is higher than the ninth potential V9, the first switch QH is in the off state, and the second switch QL is in the on state.

Thereafter, the power supply potential GVDD rises, and, from the tenth state, it is transited to an eleventh state where the power supply potential GVDD becomes an eleventh potential V11 which is higher than the tenth potential V10, the first switch QH is in the off state, and the second switch QL is in the on state. In the tenth state and the eleventh state, the potential of the drive signal COM becomes the reference potential (0 V), and the drive signal COM becomes the input of the signal modulation section 26. After the eleventh state, the modulation signal 126 changes to the high level from the low level. Hereby, the input signal IN_L of the low side gate driver 386 changes to the low level from the high level, and thereafter, the input signal IN_H of the high side gate driver 385 changes to the high level from the low level.

If the input signal IN_L is at the low level, the potential of the second switch drive signal GL changes to the reference potential (0 V) from the power supply potential GVDD. At the change point, since the second switch QL is in the state where the potential difference between the gate and the source is lower than the threshold, from the state where the potential difference between the gate and the source is higher than the threshold, the second switch QL is in the unstable state that can be any one of on or off. That is, from the eleventh state, it is transited to a twelfth state where the power supply potential GVDD becomes a twelfth potential V12 which is higher than the eleventh potential V11, the first switch QH is in the off state, and the second switch QL is in the unstable state.

Therefore, if the potential of the second switch drive signal GL becomes the reference potential (0 V), the potential difference between the gate and the source is lower than the threshold, and thus, the second switch QL is in the off state. That is, from the twelfth state, it is transited to a thirteenth state where the power supply potential GVDD becomes a thirteenth potential V13 which is higher than the twelfth potential V12, the first switch QH is in the off state, and the second switch QL is in the off state.

Hereafter, the circuit that is configured of the signal modulation section 26, the signal amplification section 28, and the signal conversion section 29, oscillates while repeating similar transition, and the drive signal COM is generated according to the original drive signal 125.

In the signal amplification section 28 described above, the second switch QL of the low side operates using the reference potential (0 V) as a reference, but the second switch QL of the high side operates using the potential of the connection node SWN which is connected to the first switch QH and the second switch QL, as a reference, and thus, the capacitor 383 for the bootstrap which functions as a floating power supply is connected between the output terminal of the charge pump 381 and the connection node SWN. Furthermore, since the connection node SWN becomes the power supply potential VHV of the high potential (for example, 42 V) at the time of turning on the first switch QH of the high side, so that the current does not flow backward to the charge pump 381 side from the connection node SWN, the diode 382 for backflow prevention is arranged between the output terminal of the charge pump 381 and the capacitor 383. When the oscillation start signal ST is input, and the second switch QL of the low side is turned on, the current flows to reference potential node (for example, ground) through the diode 382 from the charge pump 381, and the capacitor 383 is charged.

In the embodiment described herein, the power supply potential GVDD which the charge pump 381 outputs, begins to gradually rise slowly in ms order, and immediately, the potential of the second switch drive signal GL which the low side gate driver 386 outputs, also begins to rise. As a result, since the second switch QL of the low side is in the on state within the power supply potential GVDD of the relatively low potential, it is possible to make an initial current for charging the capacitor 383, to be sufficiently small. Moreover, since the first switch QH is in the off state when the initial current flows, a current path which is to the reference potential from the power supply potential VHV, is cut off, and the current flowing through the connection node SWN becomes only the initial current for charging the capacitor 383. Accordingly, it is possible to reduce the erroneous discharge of the ink and a concern for destruction of the piezoelectric element, even when a portion of the small initial current temporarily flows to the piezoelectric element PZT, through the signal conversion section 29 from the connection node SWN.

According to the embodiment described herein, the power supply potential GVDD which the charge pump 381 outputs, gradually rises in ms order, and thereby the capacitor 383 is gradually charged. Furthermore, as described above, the initial current for the charge is made to be sufficiently small, and thereby, it is possible to make an instant decrease amount of the power supply potential GVDD which the charge pump 381 outputs, to be sufficiently small. Therefore, a reverse bias is not applied before a forward direction current of the diode 382 becomes 0, or a reverse direction current (reverse current) is small even when the reverse bias is applied, and thus, it is possible to reduce the concern that the diode 382 is damaged. Accordingly, it is possible to prevent useless cost increase, without using a diode having a large current resistant amount, a fast recovery diode, or the like, as the diode 382. For example, when the diode 382 is built in an IC chip similar to the signal amplification section 28, reduction in cost and the reduction in a chip area, are achieved.

Furthermore, since the decrease amount of the power supply potential GVDD is small when the initial current flows, it is not necessary to attach a large stabilization capacitor to the output terminal of the charge pump 381, a low noise and a constant cost can be realized.

A rising time of the power supply potential GVDD, that is, the time in which the power supply potential GVDD rises from the reference potential (0 V) and reaches up to the maximum potential (for example, 10V), is preferably longer than the fixed time of charging the capacitor 383.

2. Second Embodiment

The printer 1 according to a second embodiment, includes a resistance element where the signal amplification section 28 is arranged in series with the diode 382, between the output terminal of the charge pump 381 and the capacitor 383.

Figure 11:
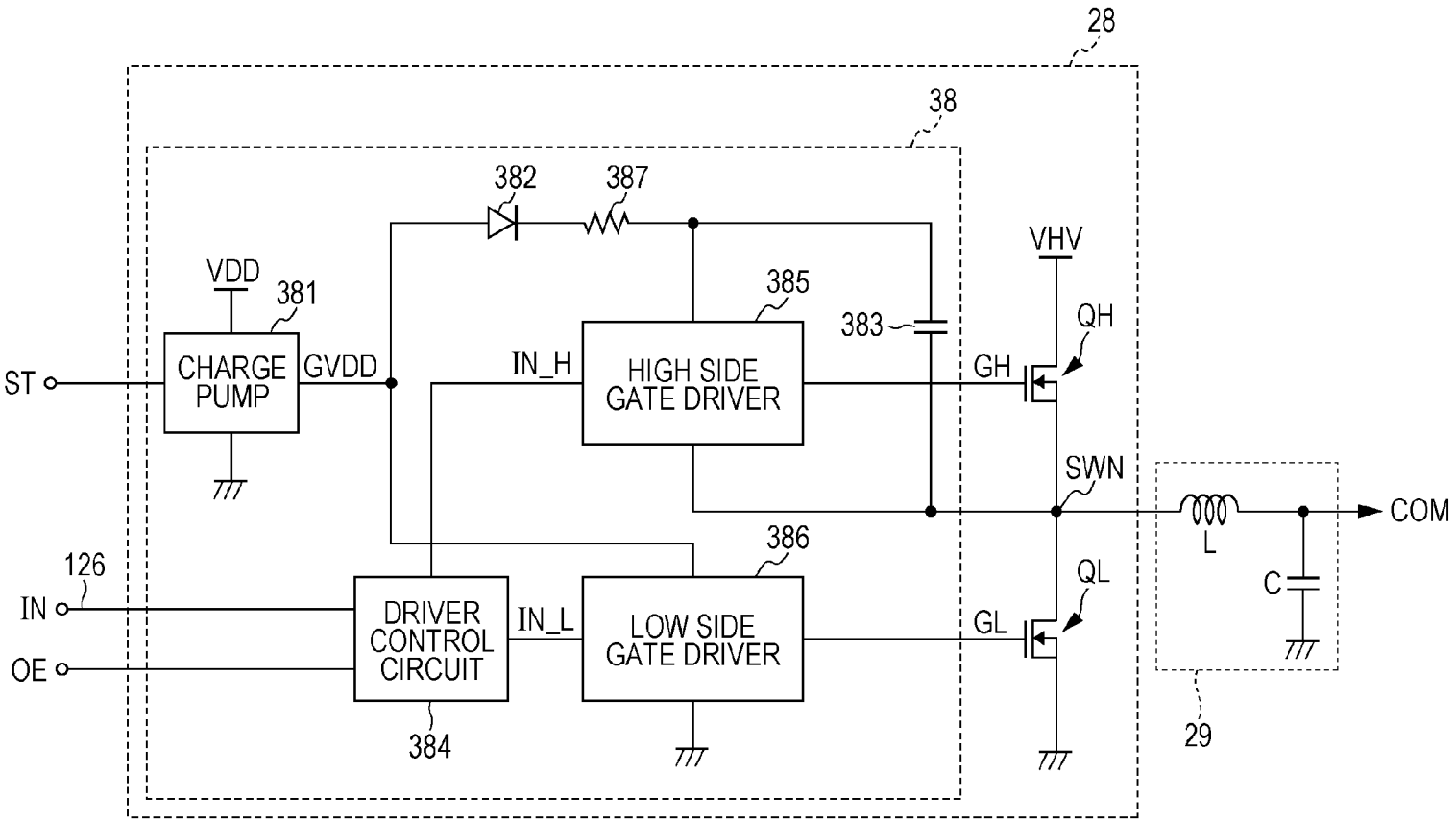
FIG. 11 is a diagram illustrating a circuit configuration example of a signal amplification section according to a second embodiment.

FIG. 11 is a diagram illustrating a circuit configuration example of the signal amplification section 28 of the printer 1 according to the second embodiment. In FIG. 11, the same reference signs are attached to the same configuration components as FIG. 9, and the description thereof is omitted. In the circuit of FIG. 11, a resistance element 387 is added with respect to the circuit of FIG. 9. In the resistance element 387, one end thereof is connected to the output terminal of the charge pump 381, and the other end is connected to the power supply terminal of the high side gate driver 385. The resistance element 387 functions as a limit resistance that limits the current for the charge of the capacitor 383.

Consequently, according to the second embodiment, in comparison with the first embodiment, since it is possible to make the current flowing to the reference potential node (ground) from the output terminal of the charge pump 381 be smaller, the erroneous discharge of the ink and the concern for the destruction of the piezoelectric element PZT, or the concern for a damage of the diode 382, can be reduced more.

3. Third Embodiment

In each embodiment described above, a ripple noise is left in the drive signal COM, due to the error which is generated with the pulse modulation in the signal modulation section 26, and demodulation in the signal amplification section 28. However, the waveform of the drive signal COM is corrupted when the ripple transmits a transmission line which is up to the piezoelectric element PZT, but if the ripple noise disappears just before the piezoelectric element PZT, or if a meniscus of the ink does not occurs subsequently by the amplitude and the frequency of the noise even when the ripple noise is left, there is no effect on the discharge of the ink, and deterioration in performance of the printer 1, does not occur.

On the other hand, in each embodiment described above, in order to reduce power consumption, when the potential of the drive signal COM does not change, the output enable signal OE is at the low level, and the oscillation by the circuit which is configured of the signal modulation section 26, the signal amplification section 28, and the signal conversion section 29, is stopped. At the time of stopping the oscillation, the first switch in company with the second switch are in the off state, but other circuits are in an operating state, and thus, the noise rides on the input signal of the comparator 35, next, the output enable signal OE is at the high level, and the state at the time of starting the oscillation becomes unfixed. Since the unfixed state is the state where a ripple phase occurring in the drive signal COM at the time of starting the oscillation becomes unstable, waveform stability of the drive signal COM is impaired. Thereupon, in a third embodiment, an oscillation start state is fixed to the same state at all times, and thereby, the stability of the ripple phase of the drive signal COM, is improved.

Figure 12:
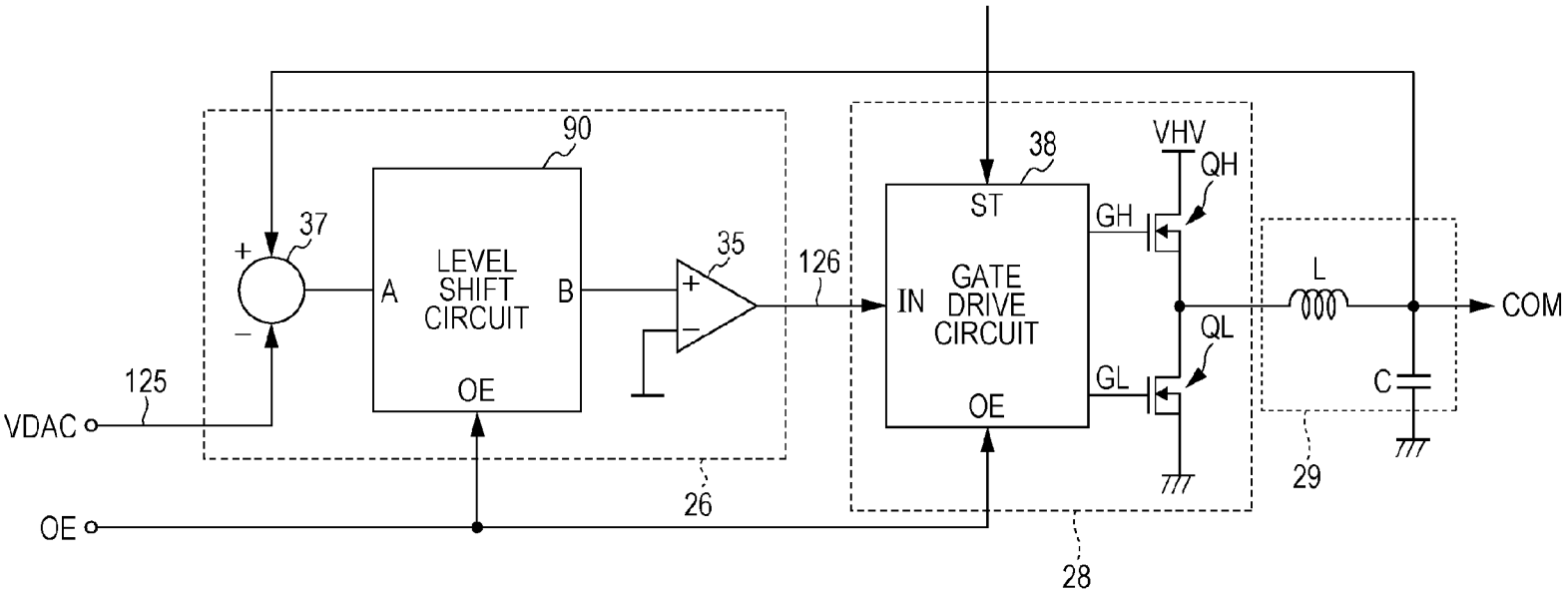
FIG. 12 is a diagram illustrating a circuit configuration example of a signal modulation section, a signal amplification section, and a signal conversion section according to a third embodiment.

FIG. 12 is a diagram illustrating a circuit configuration example of the signal modulation section 26, the signal amplification section 28, and the signal conversion section 29 of the printer 1 according to the third embodiment. In FIG. 12, the same reference signs are attached to the same configuration components as FIG. 8 or FIG. 9, and the description thereof is omitted. In the third embodiment, the point that a level shift circuit 90 is arranged between the error amplifier 37 and the comparator 35 in the signal modulation section 26, is different from each embodiment described above.

The output signal of the error amplifier 37 is input to an A terminal, the output enable signal OE is input to the OE terminal, and the level shift circuit 90 outputs the output signal of the error amplifier 37 from a B terminal when the output enable signal OE is at the high level, and fixes the potential of the B terminal to the potential which is lower or higher than a comparison voltage in the comparator 35 of the next stage when the output enable signal OE is at the low level.

Figure 13A:
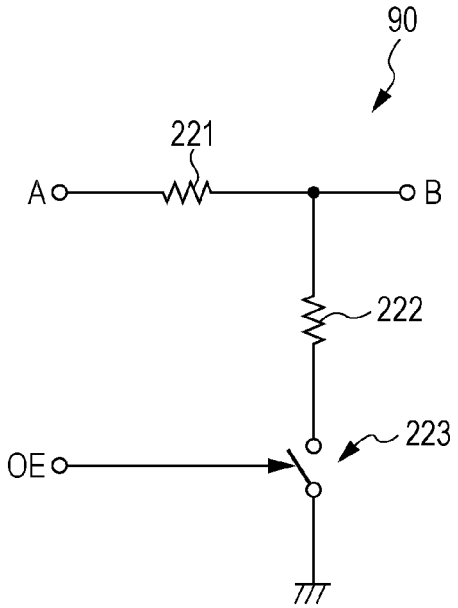
FIG. 13A and FIG. 13B are diagrams illustrating a configuration example of a level shift circuit according to the third embodiment.

FIG. 13A is a diagram illustrating a configuration example of the level shift circuit 90. In FIG. 13A, the level shift circuit 90 includes a resistance element 221 that is connected between the A terminal and the B terminal, a resistance element 222 that is connected in series between the B terminal and the reference potential node (ground), and a switch 223. The switch 223 is in the off state, if the output enable signal OE which is input to the OE terminal is at the high level, and the switch 223 is in the on state, if the output enable signal OE is at the low level. That is, when the output enable signal OE is at the high level (at the time of an oscillation operation), the output signal of the error amplifier 37 which is input to the A terminal, is propagated to the B terminal, and when the output enable signal OE is at the low level (at the time of an oscillation stop), the potential of the B terminal ignores an on resistance of the switch 223, and the potential difference between the A terminal and the reference potential node (0 V), becomes the potential which is resistance-divided by the resistance element 221 and the resistance element 222. Accordingly, when the output enable signal OE is at the low level (at the time of the oscillation stop), the potential of the B terminal is level-shifted to the direction of the reference potential (0 V). For example, a resistance value of the resistance element 222 is sufficiently larger than the resistance value of the resistance element 221, and thereby, when the output enable signal OE is at the low level (at the time of the oscillation stop), the potential of the B terminal is close to the reference potential (0 V), and becomes lower than the comparison voltage in the comparator 35 of the next stage. As a result, when the output enable signal OE is at the low level (at the time of the oscillation stop), the output of the comparator 35 is fixed to the reference potential (0 V). When the output enable signal OE is at the low level (at the time of the oscillation stop), the potential of the B terminal may be made so as to be level-shifted to the direction of the power supply potential, and in this case, the modulation signal 126 which the comparator 35 outputs, is fixed to the power supply potential VDD.

Figure 13B:
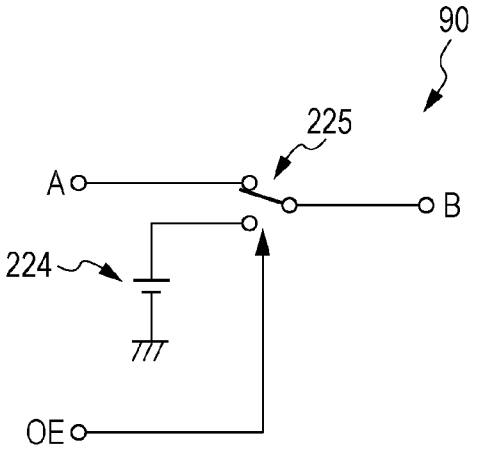

FIG. 13B is a diagram illustrating another configuration example of the level shift circuit 90. In FIG. 13B, the level shift circuit 90 includes a constant voltage source 224 that generates a constant voltage using the reference potential as a reference, and a switch 225 that selects the output signal of the error amplifier 37 which is input to the A terminal or the constant voltage from the constant voltage source 224, and outputs to the B terminal. If the output enable signal OE which is input to the OE terminal is at the high level, the switch 225 selects the output signal of the error amplifier 37, and outputs to the B terminal. If the output enable signal OE is at the low level, the switch 225 selects the constant voltage from the constant voltage source 224, and outputs to the B terminal. That is, when the output enable signal OE is at the high level (at the time of the oscillation operation), the output signal of the error amplifier 37 which is input to the A terminal, is propagated to the B terminal, and when the output enable signal OE is at the low level (at the time of the oscillation stop), the potential of the B terminal becomes the constant potential. If the constant potential which the constant voltage source 224 generates, is lower than the comparison voltage in the comparator 35 of the next stage, the modulation signal 126 which the comparator 35 outputs, is fixed to the reference potential (0 V) when the output enable signal OE is at the low level (at the time of the oscillation stop). Moreover, if the constant potential which the constant voltage source 224 generates, is higher than the comparison voltage in the comparator 35, the modulation signal 126 is fixed to the power supply potential VDD when the output enable signal OE is at the low level (at the time of the oscillation stop).

In this manner, according to the third embodiment, the oscillation start state is fixed, and thus, it is possible to improve the stability of the ripple phase of the drive signal COM at the time of the oscillation start.

4. Fourth Embodiment

In the third embodiment described above, the oscillation start state is fixed to the same state at all times, but an oscillation stop state is not fixed. Thereupon, in a fourth embodiment, by fixing the oscillation start state and the oscillation stop state to the same state at all times, the stability of the ripple phase of the drive signal COM, is further improved.

Figure 14:
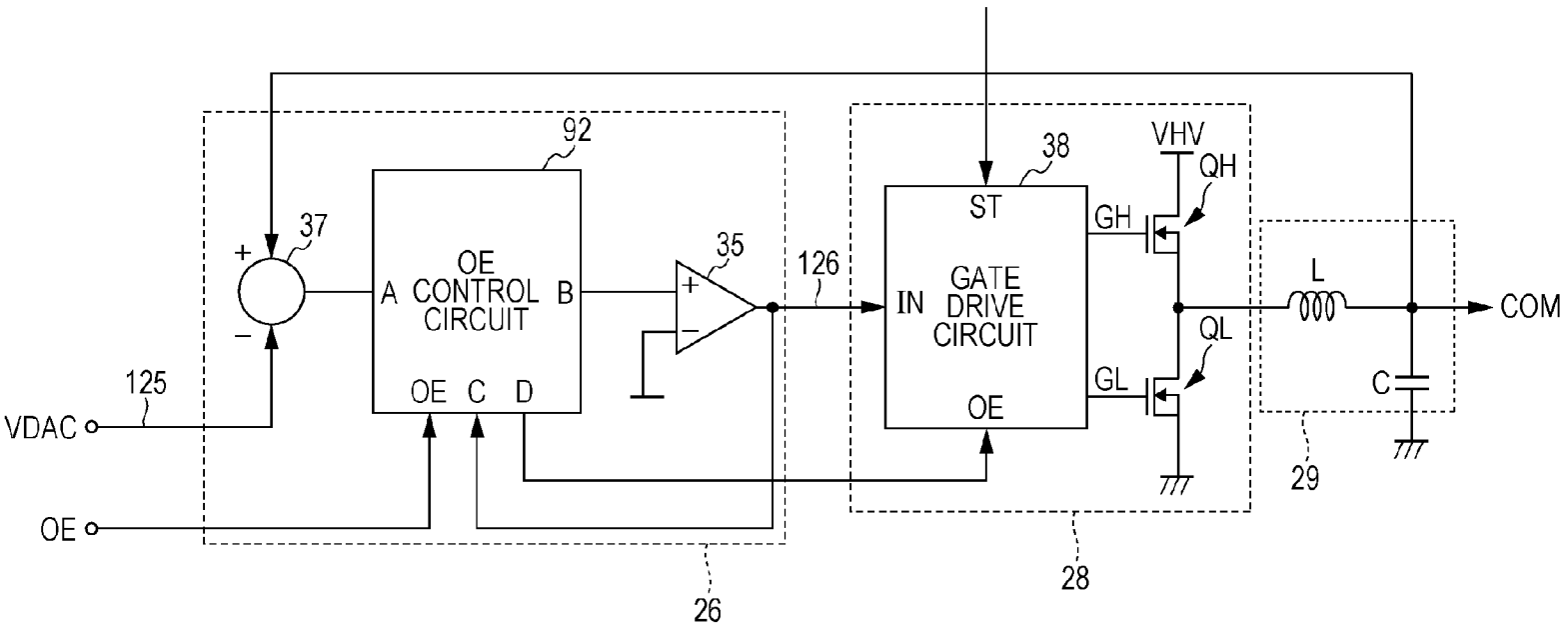
FIG. 14 is a diagram illustrating a circuit configuration example of a signal modulation section, a signal amplification section, and a signal conversion section according to a fourth embodiment.

FIG. 14 is a diagram illustrating a circuit configuration example of the signal modulation section 26, the signal amplification section 28, and the signal conversion section 29 of the printer 1 according to the fourth embodiment. In FIG. 14, the same reference signs are attached to the same configuration components as FIG. 12, and the description thereof is omitted. In the fourth embodiment, the point that an output enable (OE) control circuit 92 is arranged between the error amplifier 37 and the comparator 35 in the signal modulation section 26, instead of the level shift circuit 90, is different from the third embodiment.

The output signal of the error amplifier 37 is input to the A terminal, the output enable signal OE is input to the OE terminal, and the OE control circuit 92 inputs the modulation signal 126 which the comparator 35 outputs, to a C terminal. The OE control circuit 92 outputs the output signal of the error amplifier 37 from the B terminal when the output enable signal OE is at the high level, and fixes the potential of the B terminal to the potential which is lower or higher than the comparison voltage in the comparator 35 of the next stage when the output enable signal OE is at the low level. Moreover, the OE control circuit 92 generates an OE signal for the gate drive circuit 38 according to the output enable signal OE and the modulation signal 126, and outputs from a D terminal.

Figure 15A:
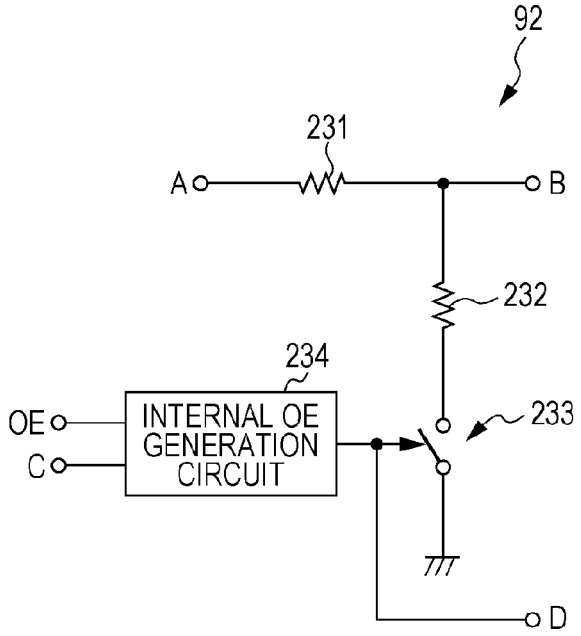
FIG. 15A and FIG. 15B are diagrams illustrating a configuration example of an OE control circuit according to the fourth embodiment.

FIG. 15A is a diagram illustrating a configuration example of the OE control circuit 92. In FIG. 15A, the OE control circuit 92 includes a resistance element 231 that is connected between the A terminal and the B terminal, a resistance element 232 that is connected in series between the B terminal and the reference potential node (ground), a switch 233, and an internal OE generation circuit 234. When the output enable signal OE is at the high level, the internal OE generation circuit 234 outputs an internal OE signal of the high level, and when the output enable signal OE changes to the low level from the high level, the internal OE generation circuit 234 outputs the internal OE signal where the modulation signal 126 falls and is at the low level. The internal OE signal is output from the D terminal, and is input to the OE terminal of the gate drive circuit 38. Accordingly, when the internal OE signal changes to the low level from the high level, and the oscillation is stopped, the output of the comparator 35 surely becomes the reference potential (0 V), and the state at the time of the oscillation stop is fixed.

The switch 233 is in the off state, if the internal OE signal which the internal OE generation circuit 234 generates, is at the high level, and the switch 223 is in the on state, if the internal OE signal is at the low level. That is, when the internal OE signal is at the high level (at the time of the oscillation operation), the output signal of the error amplifier 37 which is input to the A terminal, is propagated to the B terminal, and when the internal OE signal is at the low level (at the time of the oscillation stop), the potential of the B terminal ignores the on resistance of the switch 233, and the potential difference between the A terminal and the reference potential node (0 V), becomes the potential which is resistance-divided by the resistance element 231 and the resistance element 232. Accordingly, when the internal OE signal is at the low level (at the time of the oscillation stop), the potential of the B terminal is level-shifted to the direction of the reference potential (0 V). For example, the resistance value of the resistance element 232 is sufficiently larger than the resistance value of the resistance element 231, and thereby, when the internal OE signal is at the low level (at the time of the oscillation stop), the potential of the B terminal is close to the reference potential (0 V), and becomes lower than the comparison voltage in the comparator 35 of the next stage. As a result, when the internal OE signal is at the low level (at the time of the oscillation stop), the output of the comparator 35 is fixed to the reference potential (0 V). Hereby, the state at the time of the next oscillation start, is also fixed.

Furthermore, when the output enable signal OE changes to the low level from the high level, the internal OE generation circuit 234 may output the internal OE signal where the modulation signal 126 rises and is at the low level. Even in this case, when the internal OE signal changes to the low level from the high level, and the oscillation is stopped, the output of the comparator 35 surely becomes the power supply voltage VDD, and the state at the time of the oscillation stop is fixed.

Moreover, when the internal OE signal is at the low level (at the time of the oscillation stop), the potential of the B terminal may be made so as to be level-shifted to the direction of the power supply potential, and in this case, the modulation signal 126 which the comparator 35 outputs, is fixed to the power supply potential VDD. Hereby, the state at the time of the next oscillation start, is also fixed.

Figure 15B:
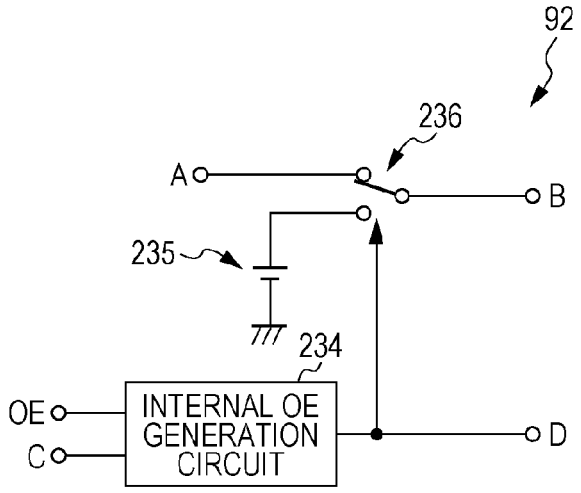

FIG. 15B is a diagram illustrating another configuration example of the OE control circuit 92. In FIG. 15B, the OE control circuit 92 includes the internal OE generation circuit 234, a constant voltage source 235 that generates the constant voltage using the reference potential as a reference, and a switch 236 that selects the output signal of the error amplifier 37 which is input to the A terminal or the constant voltage from the constant voltage source 235, and outputs to the B terminal. Since the function of the internal OE generation circuit 234 is the same as FIG. 13A, the description thereof is omitted. By the internal OE generation circuit 234, the state at the time of the oscillation stop, is fixed.

If the internal OE signal is at the high level, the switch 236 selects the output signal of the error amplifier 37, and outputs to the B terminal. If the internal OE signal is at the low level, the switch 236 selects the constant voltage from the constant voltage source 235, and outputs to the B terminal. That is, when the internal OE signal is at the high level (at the time of the oscillation operation), the output signal of the error amplifier 37 which is input to the A terminal, is propagated to the B terminal, and when the internal OE signal is at the low level (at the time of the oscillation stop), the potential of the B terminal becomes the constant potential. If the constant potential which the constant voltage source 235 generates, is lower than the comparison voltage in the comparator 35 of the next stage, the modulation signal 126 which the comparator 35 outputs, is fixed to the reference potential (0 V) when the internal OE signal is at the low level (at the time of the oscillation stop). Moreover, if the constant potential which the constant voltage source 235 generates, is higher than the comparison voltage in the comparator 35, the modulation signal 126 is fixed to the power supply potential VDD when the internal OE signal is at the low level (at the time of the oscillation stop). Hereby, the state at the time of the next oscillation start, is also fixed.

As described above, according to the fourth embodiment, since the oscillation stop state is fixed, it is possible to improve the stability of the ripple phase of the drive signal COM at the time of the oscillation start, and, since the oscillation start state is also fixed, it is possible to stabilize the potential of the drive signal COM at the time of the oscillation stop.

5. Fifth Embodiment

In each embodiment described above, for example, self-excited oscillation frequency varies, due to variation in the coil L and the capacitor C which are included in the signal conversion section 29, and the amplitude of the ripple occurring in the drive signal COM, varies. If the amplitude of the ripple varies, a center voltage of the ripple also varies, and there is the concern that waveform accuracy of the drive signal COM deteriorates. Thereupon, in the fifth embodiment, the function of automatically adjusting the center voltage of the ripple occurring in the drive signal COM, is added.

Figure 16:
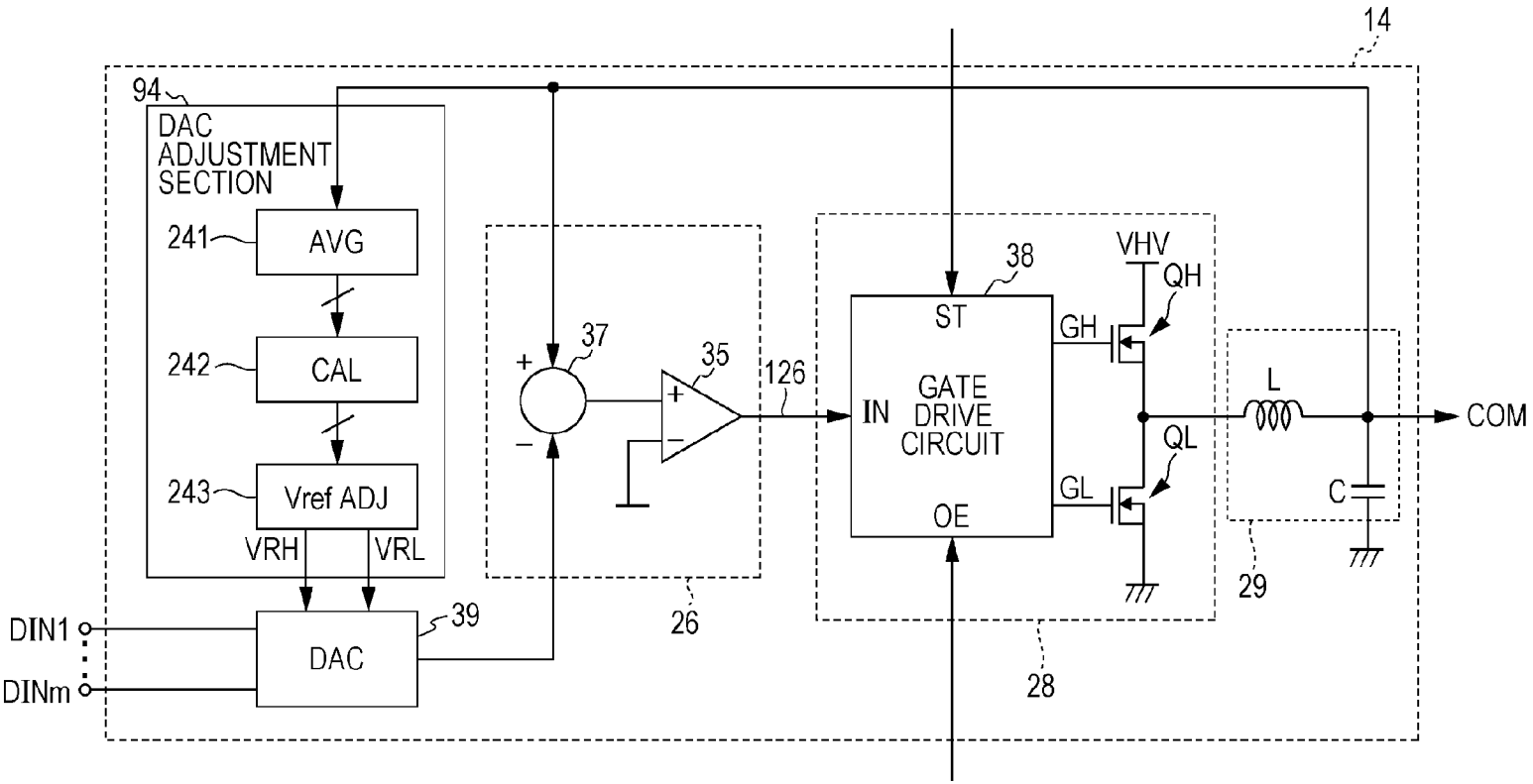
FIG. 16 is a diagram illustrating a circuit configuration example of a drive signal generation section according to a fifth embodiment.

FIG. 16 is a diagram illustrating a circuit configuration example of the drive signal generation section 14 of the printer 1 according to a fifth embodiment. In FIG. 16, the same reference signs are attached to the same configuration components as FIG. 8 or FIG. 9, and the description thereof is omitted. In the fifth embodiment, the point that a DAC adjustment section 94 that adjusts the reference voltage of the DAC 39 according to the ripple occurring in the drive signal COM, is arranged in the drive signal generation section 14, is different from each embodiment described above.

The DAC adjustment section 94 includes an average value measurement circuit 241, a correction value calculation circuit 242, and a reference voltage adjustment circuit 243. In the embodiment described herein, the CPU 12 is shifted to a reference voltage adjustment mode of the DAC 39, and input terminals DIN1 to DINm of m pieces of the DAC 39 are set to a fixed value, respectively, in the mode. In the state, the average value measurement circuit 241 measures an average value of the ripple occurring in the drive signal COM. Next, until the average value of the ripple which the average value measurement circuit 241 measures, falls within a target value range, the correction value calculation circuit 242 sends a correction value to the reference voltage adjustment circuit 243. According to the correction value from the correction value calculation circuit 242, the reference voltage adjustment circuit 243 adjusts a reference voltage VRH of the high potential side and a reference voltage VRL of the low potential side of the DAC 39. Therefore, the reference voltage adjustment circuit 243 stores the reference voltage VRH and the reference voltage VRL corresponding to the correction value when the average value of the ripple falls within the target value range, and the CPU 12 is shifted to a normal operation mode (output mode of the drive signal COM). For example, the reference voltage adjustment mode of the DAC is automatically performed for each power supply of the printer 1.

As described above, according to the fifth embodiment, since a voltage error of the drive signal COM is automatically corrected, it is possible to maintain the waveform accuracy of the drive signal COM, regardless of the variation in the component and the variation with time. Accordingly, the component that has the large error and the lower cost, can be used.

Each embodiment described above, is not limited to the liquid ejecting type printing apparatus of the line head method, and obtains the similar effect in the case of applying to, for example, the liquid ejecting type printing apparatus of other method such as a serial head method.

6. Other

The invention includes the configuration (for example, the configuration of which the function, the method and the result are the same, or the configuration of which the purpose and the effect are the same) which is substantially same as the configuration describing examples and application examples described above. The invention also includes the configuration that replaces the portion which is not the nature of the configuration describing the examples or the like. Further, the invention includes the configuration that performs the same operations and effects as the configuration describing the examples or the like, or the configuration that achieves the same purpose. Moreover, the invention includes the configuration that adds the well-known technology to the configuration describing the examples or the like.

The invention is not limited to the embodiment described herein, and can be variously modified within the range of the gist of the invention.

For example, in each embodiment described above, the charge pump 381 is used as a power supply of the high side gate driver 385 and the low side gate driver 386, but it is not limited to the charge pump. If the power supply can output the power supply potential which gradually rises, any power supply may be used, and for example, the power supply using a RC fixed time circuit, may be used.

The embodiments described above are merely examples, and the invention is not limited thereto. For example, it is possible to appropriately combine each embodiment.

What is claimed is:

1. A liquid discharge apparatus, comprising:

a head driver having an original driving signal generating section that generates an original driving signal which is a base of a driving signal for driving a head;

a signal modulation section that generates a modulation signal by modulating the original driving signal;

a signal amplification section that has a first switch and a second switch, and generates an amplified modulation signal by amplifying the modulation signal based on driving of the first switch and the second switch; and a signal conversion section that generates the driving signal by smoothing the amplified modulation signal, wherein when a CPU which controls the head driver outputs a output enable signal, the first switch and the second switch are controlled by the output enable signal so that both the first switch and the second switch are in an off state, and the output enable signal selectively fixes an output of the modulation signal one of a low level electric potential and a high level electric potential, and wherein the output of the modulation signal is fixed in response to an electric potential of the modulation signal being set to the low level.

2. The liquid discharge apparatus according to claim 1, the signal modulation section further comprising a comparator which generates the modulation signal, wherein, based on the output enable signal, the electric potential of the modulation signal is fixed to the low level in response to an electric potential of a signal inputted to the comparator decreasing.

3. The liquid discharge apparatus according to claim 1, the signal modulation section further comprising a comparator that generates the modulation signal, wherein, based on the output enable signal, the electric potential of the modulation signal is fixed to the low level in response to a signal of predetermined potential being inputted to the comparator.

4. The liquid discharge apparatus according to claim 1, the signal modulation section further comprising a control circuit that receives the output enable signal and the modulation signal, and that controls output of the modulation signal based on the output enable signal and the modulation signal, wherein when a potential of the modulation signal changes after the output enable signal is inputted, the control circuit fixes the output of the modulation signal to the low level or the high level.

5. The liquid discharge apparatus according to claim 1, wherein when a potential of the driving signal does not change, the first switch and the second switch are controlled by the output enable signal so that both the first switch and the second switch are an off state.

6. The liquid discharge apparatus of claim 1 wherein the signal modulation section is communicably coupled to the CPU and receives the output enable signal from the CPU.

7. A liquid discharge apparatus comprising:

a head driver having an original driving signal generating section that generates an original driving signal which is a base of a driving signal for driving a head;

a signal modulation section that generates a modulation signal by modulating the original driving signal;

a signal amplification section that has a first switch and a second switch, and generates an amplified modulation signal by amplifying the modulation signal based on driving of the first switch and the second switch; and a signal conversion section that generates the driving signal by smoothing the amplified modulation signal, wherein when a CPU which controls the head driver outputs a output enable signal, the first switch and the second switch are controlled by the output enable signal so that both the first switch and the second switch are in an off state, and the output enable signal selectively fixes an output of the modulation signal one of a low level electric potential and a high level electric potential, and wherein the output of the modulation signal is fixed in response to an electric potential of the modulation signal being set to the high level.

8. The liquid discharge apparatus according to claim 7, the signal modulation section further comprising a comparator which generates the modulation signal, wherein, based on the output enable signal, the electric potential of the modulation signal is fixed to the high level in response to a potential of a signal inputted to the comparator increasing.

9. The liquid discharge apparatus according to claim 7, the signal modulation section further comprising a comparator that generates the modulation signal, wherein, based on the output enable signal, the potential of the modulation signal is fixed to the high level in response to a signal of constant potential being inputted to the comparator.

10. A driver that generates a driving signal for driving a capacitive load comprising:

an original driving signal generating section that generates an original driving signal which is a base of the driving signal;

a signal modulation section that generates a modulation signal by modulating the original driving signal;

a signal amplification section that has a first switch and a second switch, and generates an amplified modulation signal by amplifying the modulation signal based on driving of the first switch and the second switch; and a signal conversion section that generates the driving signal by smoothing the amplification modulation signal, wherein when a CPU which controls the head driver outputs a output enable signal, the first switch and the second switch are controlled by the output enable signal so that both the first switch and the second switch are in an off state, and the output enable signal selectively fixes an output of the modulation signal to a desired one of a low level electric potential and a high level electric potential, and wherein the output of the modulation signal is fixed in response to an electric potential of the modulation signal being set to the low level.

11. The driver of claim 10 wherein the signal modulation section is communicably coupled to the CPU and receives the output enable signal from the CPU.

12. A driver that generates a driving signal for driving a capacitive load comprising:

an original driving signal generating section that generates an original driving signal which is a base of the driving signal;

a signal modulation section that generates a modulation signal by modulating the original driving signal;

a signal amplification section that has a first switch and a second switch, and generates an amplified modulation signal by amplifying the modulation signal based on driving of the first switch and the second switch; and a signal conversion section that generates the driving signal by smoothing the amplification modulation signal, wherein when a CPU which controls the driver outputs a output enable signal, the first switch and the second switch are controlled by the output enable signal so that both the first switch and the second switch are in an off state, and the output enable signal selectively fixes an output of the modulation signal to a desired one of a low level electric potential and a high level electric potential, and wherein the output of the modulation signal is fixed in response to an electric potential of the modulation signal being set to the high level.

* * * * *